US011502445B2

(12) United States Patent
Murphy et al.

(10) Patent No.: US 11,502,445 B2
(45) Date of Patent: Nov. 15, 2022

(54) TAMPER-RESISTANT ELECTRICAL WIRING DEVICES

(71) Applicant: Pass & Seymour, Inc., Syracuse, NY (US)

(72) Inventors: Patrick J. Murphy, Marcellus, NY (US); Alec J. Brindisi, Syracuse, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 17/397,394

(22) Filed: Aug. 9, 2021

(65) Prior Publication Data

US 2022/0140518 A1 May 5, 2022

Related U.S. Application Data

(60) Provisional application No. 63/063,713, filed on Aug. 10, 2020, provisional application No. 63/144,505, filed on Feb. 2, 2021.

(51) Int. Cl.
*H01R 39/00* (2006.01)
*H01R 13/453* (2006.01)
*H01R 24/70* (2011.01)

(52) U.S. Cl.
CPC ..... *H01R 13/4532* (2013.01); *H01R 13/4536* (2013.01); *H01R 24/70* (2013.01)

(58) Field of Classification Search
CPC ..... H01R 35/025; B60R 16/027
See application file for complete search history.

(56) References Cited

U.S. PATENT DOCUMENTS 5,988,735 A * 11/1999 Muller ..... B60R 13/0225 280/730.2
6,033,189 A * 3/2000 Miura ..... F16K 31/0655 335/255
6,893,275 B2 * 5/2005 Ng ..... H01R 13/4534 439/140
7,452,221 B1 11/2008 Oddsen et al.
7,642,457 B2 1/2010 Weeks et al.
7,645,148 B2 1/2010 Carbone et al.
8,044,299 B2 10/2011 Weeks
8,672,695 B2 3/2014 Baldwin et al.
9,502,806 B2 * 11/2016 Ewer ..... H01R 13/4534
9,543,685 B2 1/2017 Mortun et al.
(Continued)

*Primary Examiner* — Phuong Chi Thi Nguyen
(74) *Attorney, Agent, or Firm* — Bond, Schoeneck & King, PLLC; Frederick J. M. Price

(57) ABSTRACT

An electrical wiring device including a housing including a front cover coupled to at least one body member, the front cover including a plurality of receptacle openings in a major front surface thereof, the plurality of receptacle openings being configured to receive a plurality of plug blades of a corded electrical plug, wherein the plurality of receptacle openings includes at least a ground prong opening and the at least one body member includes at least one set of receptacle contacts including a hot receptacle contact and a neutral receptacle contact; and a shutter assembly positioned within the housing and including a first shutter member coupled to a second shutter member, wherein the first shutter member is configured to move from a first position to a second position when a ground prong is inserted through the ground prong opening.

18 Claims, 33 Drawing Sheets

(56) References Cited

U.S. PATENT DOCUMENTS

| | | | | |
|---|---|---|---|---|
| 10,096,929 | B2 * | 10/2018 | Lee | H01R 13/4534 |
| 10,958,009 | B2 * | 3/2021 | Mozdzer | H01R 13/4532 |
| 2004/0147148 | A1 * | 7/2004 | Ng | H01R 13/4534<br>439/137 |

* cited by examiner

TAMPER-RESISTANT ELECTRICAL WIRING DEVICES

CROSS-REFERENCE TO RELATED APPLICATIONS

This application claims priority to U.S. Provisional Patent Application Ser. No. 63/063,713 filed on Aug. 10, 2020, and U.S. Provisional Patent Application Ser. No. 63/144,505 filed on Feb. 2, 2021, the content of each is relied upon and incorporated herein by reference in its entirety, and the benefit of priority under 35 U.S.C. § 119(e) is hereby claimed.

BACKGROUND OF THE INVENTION

1. Field of the Invention

The present invention relates generally to electrical wiring devices, and particularly to tamper-resistant electrical wiring devices.

2. Description of the Related Art

Electrical power is provided to users by way of electrical distribution systems that typically include electrical wiring from a utility power source to a breaker panel disposed in a house, building or some other facility. The breaker panel distributes AC power to one or more branch electric circuits installed in the structure. The electric circuits may typically include one or more electrical wiring devices that regulate, monitor or provide AC power to other devices. There are a variety of electrical wiring devices available to the consumer including outlet receptacles, light switches, dimmers, ground fault circuit interrupters, arc fault circuit interrupters and the like. Each electrical wiring device typically is equipped with electrical terminals that provide a means for connecting the device to the source of AC power and a means for connecting the device to a load. Specifically, line terminals couple the device to the source of AC electrical power, whereas load terminals couple power to the load. Load terminals may also be referred to as "feed-through" or "downstream" terminals because the wires connected to these terminals may be coupled to a daisy-chained configuration of receptacles or switches.

Thus, an electric circuit may include many different electrical wiring devices disposed at various locations throughout a structure. Outlet receptacles, switches and protective devices are examples or types of electrical wiring devices. Ground fault circuit interrupters (GFCIs), and are fault circuit interrupters (AFCIs) are examples of protective devices in electric circuits. Switches, protective devices and other types of electrical devices are often provided in combination with receptacles. For example, outlet receptacles are disposed in duplex receptacles, raceways, multiple outlet strips, power taps, extension cords, light fixtures, appliances, and the like. When the wiring terminations of these devices (i.e., wiring terminals, plugs, etc.) of these devices are connected to the electrical distribution system, the receptacle contacts may be energized. When the power cord of an electrical appliance is inserted into the receptacle outlet, the device is also energized.

When a foreign object is inserted into a receptacle opening it may represent a safety hazard. Specifically, young children and toddlers are known to have a proclivity toward inserting objects such as paper clips or screwdriver blades into receptacle contact openings. (This should be a cause for alarm, especially in light of the fact that, e.g., GFCIs are configured to trip in response to a mere 6 mA current). Even a small current (in the mA range) passing through a human body to ground can result in an electric shock, burns, or electrocution (a fatal shock event). As a result, the use of shuttered openings in electrical receptacles has long been in use in an attempt to prevent the insertion of foreign objects into the receptacle contact openings. One drawback to this approach relates to the ineffectiveness of related art designs. In many conventional designs, when objects are placed into both openings, the shutter will typically operate, exposing the child to a shock hazard. What is needed is a shutter mechanism that only opens when an actual corded plug is inserted into the receptacle.

Another drawback to this approach relates to the complexity of related art shutters. Many shutter designs comprise multiple and structurally complicated parts and spring elements. For example, in one conventional approach that has been considered, the shutter must be intricately installed within a base platform (by hand) after positioning a delicate leaf spring element within the base. The cost and time of assembling the shutter mechanism, and the space taken up by their multiple parts, limit the usage of these designs. Moreover, automated environments often generate vibrations and mechanical forces that tend to introduce failure modes. Specifically, vibrations tend to cause the leaf spring to become dislodged or otherwise become separated from the platform. In addition, when objects are inserted into the receptacle opening, the shutter is forced to press against the leaf spring while moving upwardly and downwardly within the base platform. This type of movement increases the likelihood that the leaf spring will be dislodged. Once this happens, the receptacle device is either inoperable or unprotected.

What is needed is a shutter assembly that is configured to operate smoothly (and robustly) even when foreign objects or uneven plug blades are forcefully inserted. What is also needed is relatively simple (but still effective) protective shutter assembly that is easy to install within an electrical wiring device.

Additional background information regarding protective electrical wiring devices can be found, for example, in the background section of U.S. Pat. Nos. 9,437,386 and 10,020,649 and U.S. Pub App. No. 20210035760. Additional background information regarding tamper resistant mechanisms for electrical wiring devices can be found, for example, in U.S. Pat. Nos. 9,847,611, 9,543,715 and 9,893,456.

Description of the Related Art Section Disclaimer: To the extent that specific patents/publications/products are discussed above in this Background Section or elsewhere in this application, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products (and/or specific portions thereof) are discussed above in this Background Section and/or throughout the application, the descriptions/disclosures of which are all hereby incorporated by reference into this document in their respective entirety(ies) (or at least the specific references sections are incorporated by reference into this document in their respective entirety(ies), as may be applicable).

BRIEF SUMMARY OF THE INVENTION

The present invention addresses the needs described above by providing electrical wiring devices with certain tamper-resistant shutter mechanisms. In particular, shutter assemblies are described and illustrated that are structured and configured to operate smoothly (and robustly) within an electrical wiring device even when foreign objects or uneven plug blades are forcefully inserted. The present invention also provides a relatively simple, yet very effective, protective shutter assemblies that are easy to install within an electrical wiring device. The details of one or more embodiments of the shutter assemblies are further described herein, including embodiments related to shutter assemblies positioned in a 250V tamper resistant electrical receptacle. Although embodiments illustrated in and described with respect to the Figures show shutter assemblies as part of a 250V tamper resistant electrical receptacle, the shutter assemblies are not restricted to such receptacles. Indeed, the shutter assemblies described herein can be incorporated into any electrical wiring device including into a modular device, a duplex receptacle and in other receptacles such as, but not limited to, Applicant's Radiant®, Harmony® and Adorne® (see, e.g., U.S. Pub App. Nos. 2020/0185898, 20210035760) branded lines of receptacles.

Electrical wiring devices (as the non-limiting term is used herein, and as should be understood by those of ordinary skill in the art) may be configured as an outlet receptacle or as a protective device, such as a ground fault circuit interrupter (GFCI), an arc fault circuit interrupter (AFCI), a transient voltage surge suppressor (TVSS), or a surge protective device (SPD). Other electrical wiring device examples include switches, dimmers, fan speed controls, night lights, low voltage ports, or USB ports. The electrical wiring devices may also be a smart device or smart version of any of the previously wiring device types. Finally, each of these electrical wiring device types may be found in mix-and-match combinations with other kinds of these wiring devices. For example, a GFCI/AFCI combination device may be included within a single housing.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIG. 21 is a front perspective view of a tamper resistant electrical receptacle with certain components removed according to the embodiment shown in FIG. 3;

DETAILED DESCRIPTION

Figure 1:
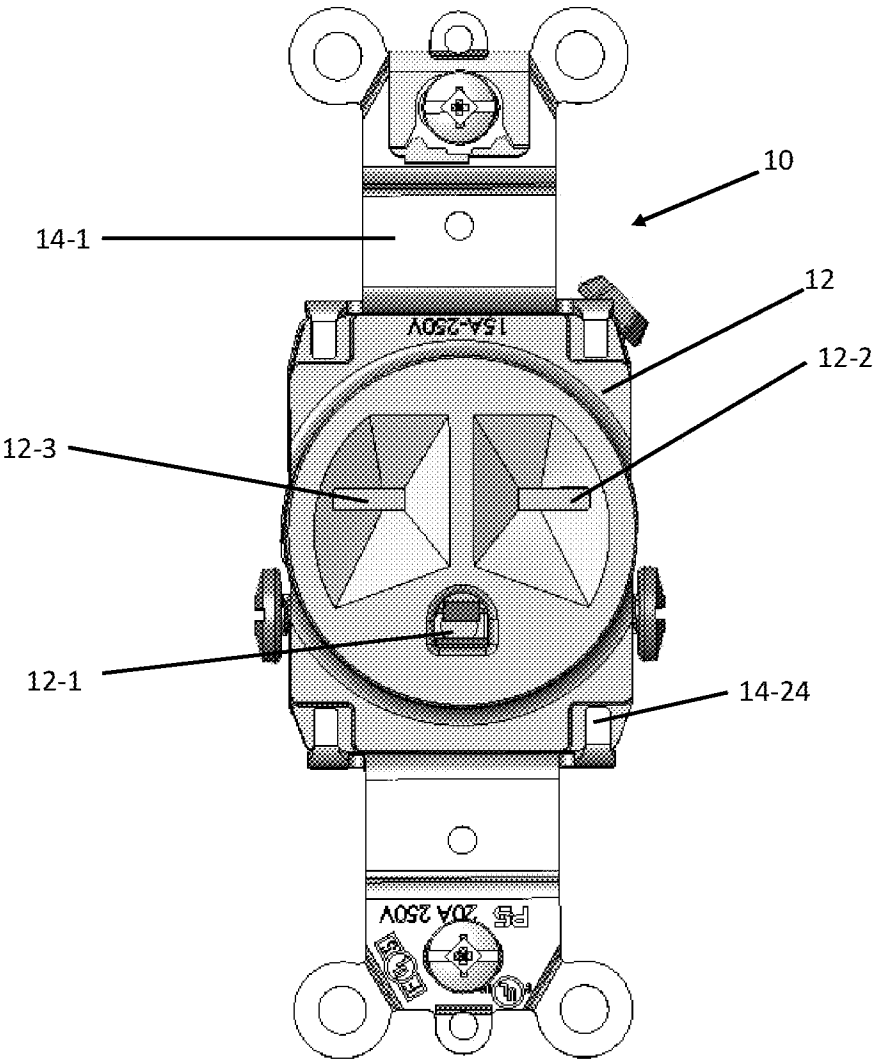
FIG. 1 is a front perspective view of a tamper resistant electrical receptacle according to an embodiment.

Reference will now be made in detail to the present exemplary embodiments of the invention, examples of which are illustrated in the accompanying drawings. Wherever possible, the same reference numbers will be used throughout the drawings to refer to the same or like parts. Discussion or illustration of a particular element or structural configuration does not mean that that particular element or structural configuration is required. A 15A version and a 20A version of a 250V tamper resistant electrical receptacle are described and illustrated herein, and designated generally throughout by reference numeral 10 or 10', respectively. The associated unique shutter assemblies incorporated into these devices are designated by reference numeral 20 or 20', respectively. In accordance with another embodiment, the 20A tamper resistant shutter assembly design described herein can be used in the 15A device, and the 15A tamper resistant shutter assembly design can be used in the 20A device.

As described in further detail below, the shutter assemblies 20 or 20' of embodiments of the present invention are positioned and are actuatable within respective electrical wiring devices and feature two main shutter positions: blocking position (resting state) and an open position (actuated state). The shutter assemblies can be structured, shaped and configured to be assembled in and work with other electrical wiring devices which are structurally different from the 15A and 20A devices described herein, while maintaining the same or similar blocking position, open position, and movement in single/parallel plane between the two positions structure and functionality as described herein.

With reference to FIGS. 1, 2, 5A, 6-13 and 22-24, a shutter design is illustrated and may be used in an electrical wiring device 10, which is shown herein as a 15A receptacle device. With reference to FIGS. 3, 4, 5B, 14-24, a shutter assembly design is illustrated and can be used in an electrical wiring device 10', which is shown herein as a 20A receptacle device. Obviously, the shutter assembly design embodiments can be adapted for use in other electrical wiring devices such as GFCIs, AFCIs, TVSSs and the like (as discussed above).

Figure 2:
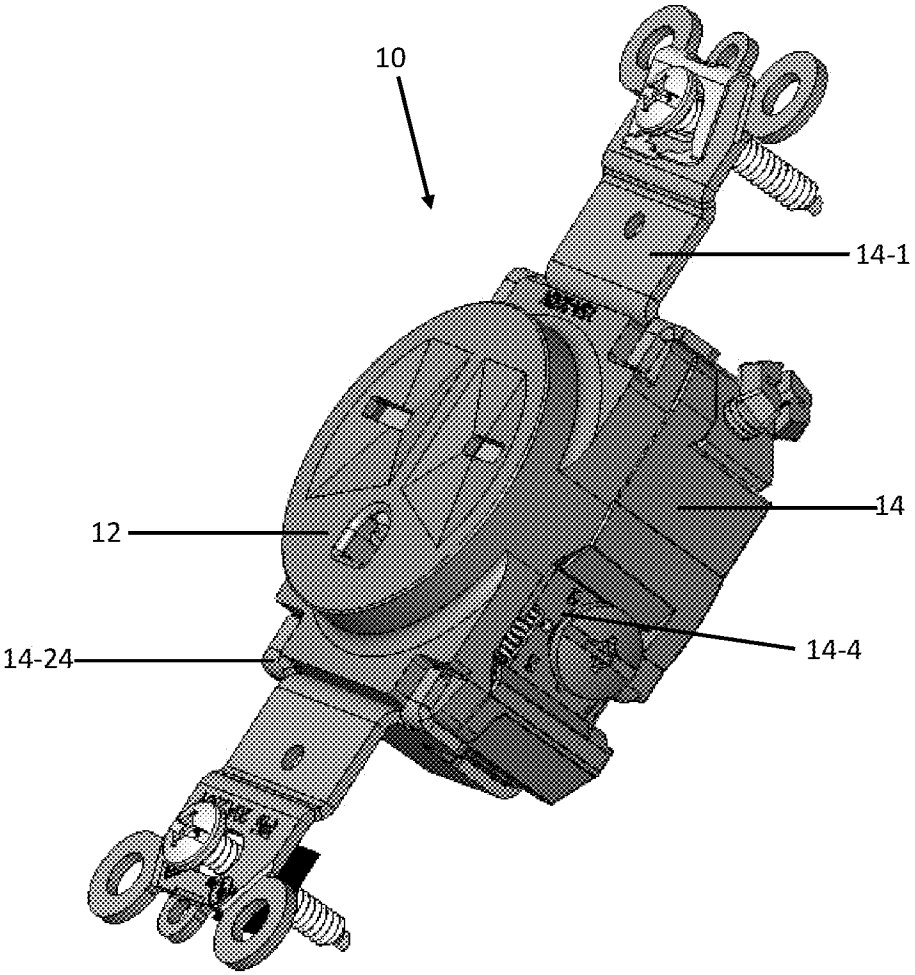
FIG. 2 is a front right side perspective view of a tamper resistant electrical receptacle according to the embodiment shown in FIG. 1.

Turning to FIGS. 1-2, front and front right side perspective views of a 15A version of a 250V tamper resistant electrical receptacle 10, respectively, are shown. Receptacle 10 includes a cover 12 attached to a body 14. The receptacle 10 is a single receptacle device and thus provides one set of plug blade openings. The set of plug blade openings includes a ground prong aperture 12-1, a hot blade opening 12-2 and a neutral blade opening 12-3. The cover 12 is configured to mate with the body 14 positioned on a ground strap 14-1, and the ground strap 14-1 includes one or more clips 14-24 to hold the cover 12 and body 14 in place together. Hot terminal 14-4 is also shown. Shutter assembly 20 is positioned in contacting relation to a frame 20-1 (not shown) between the cover 12 and body 14.

Figure 3:
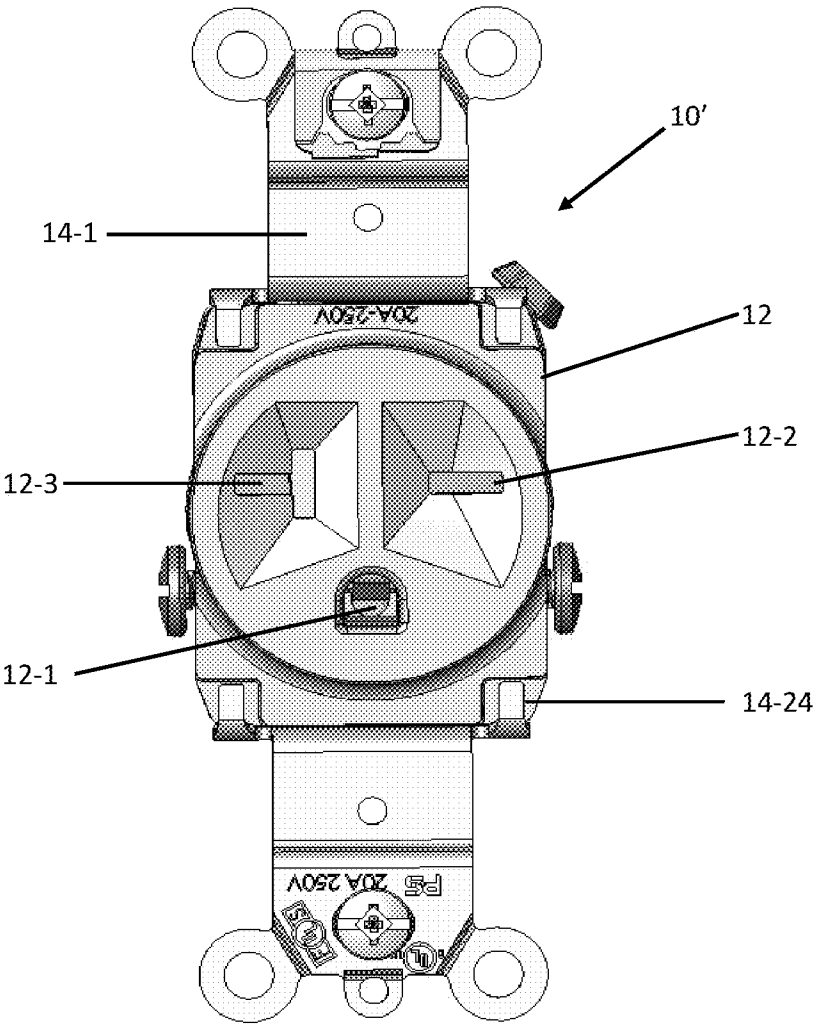
FIG. 3 is a front perspective view of a tamper resistant electrical receptacle according to an alternative embodiment.
Figure 4:
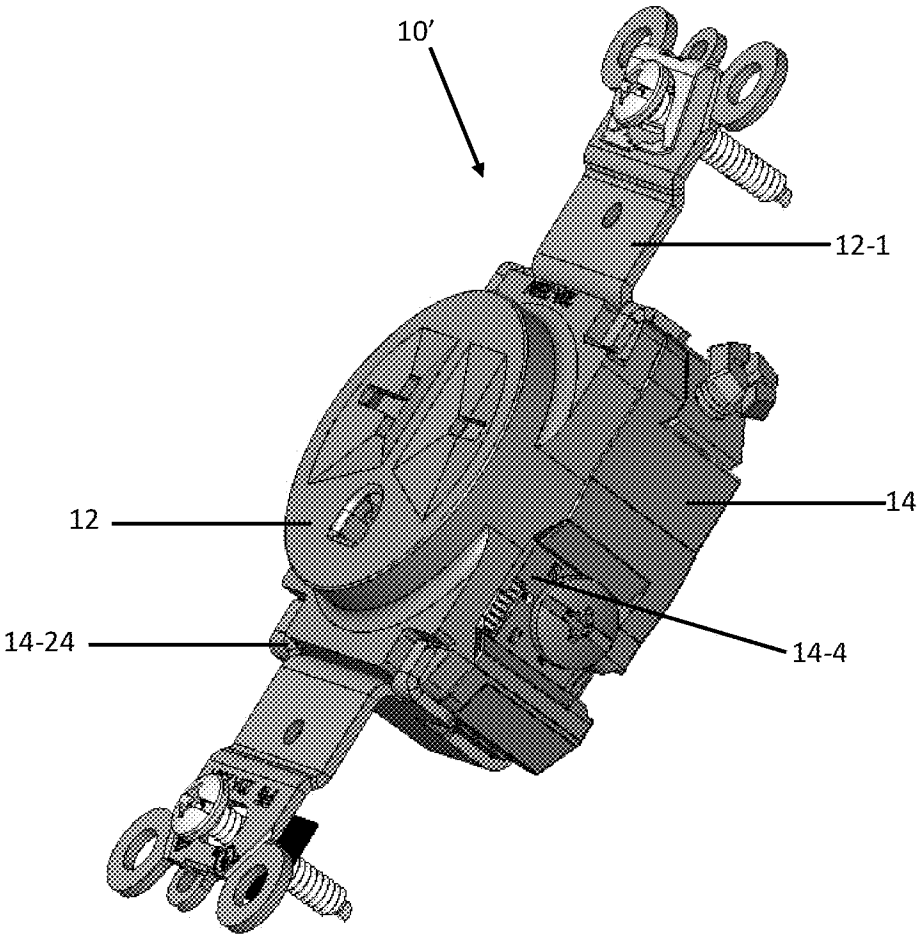
FIG. 4 is a front right side perspective view of a tamper resistant electrical receptacle according to the embodiment shown in FIG. 3.

Turning to FIGS. 3-4, front and front right side perspective views of a 20A version of a 250V tamper resistant electrical receptacle 10', respectively, are shown. Similar to receptacle 10, receptacle 10' includes a cover 12 attached to a body 14. The receptacle 10' is also a single receptacle device and thus provides one set of plug blade openings. The set of plug blade openings includes a ground prong aperture 12-1, a hot opening 12-2 and a neutral opening 12-3. The cover 12 is configured to mate with a body 14 positioned on a ground strap 14-1, and the ground strap 14-1 includes one or more clips 14-24 to hold the cover 12 and body 14 in place together. Hot terminal 14-4 is also shown. Shutter assembly 20' is positioned in contacting relation to a frame 20-1 (not shown) between the cover 12 and body 14.

Figure 5A:
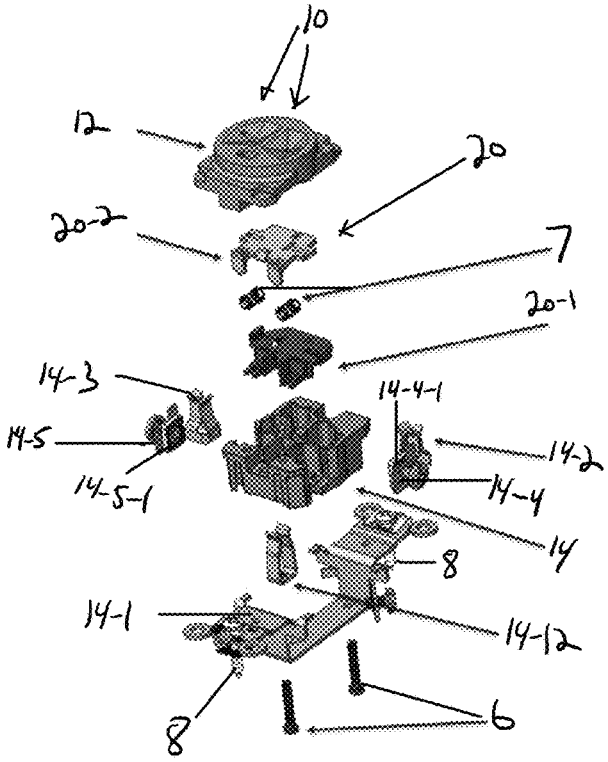
FIG. 5A is an exploded view of a tamper resistant electrical receptacle according to the embodiment shown in FIG. 1.
Figure 5B:
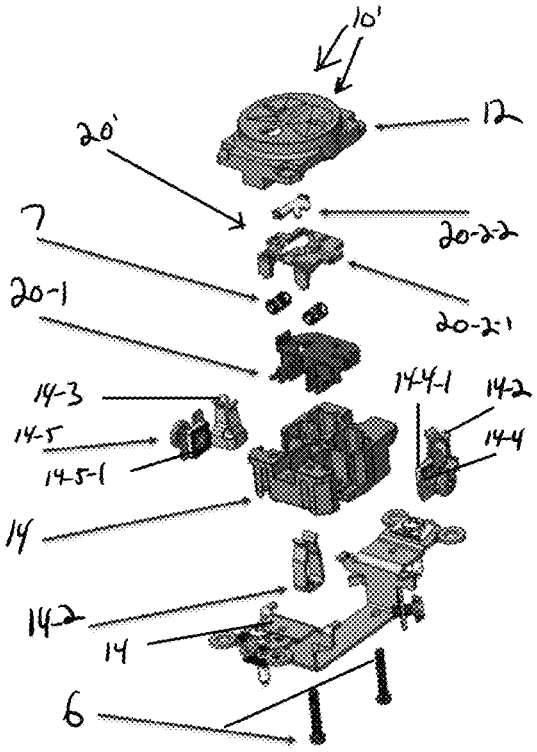
FIG. 5B is an exploded view of a tamper resistant electrical receptacle according to the embodiment shown in FIG. 1.

Turning to FIGS. 5A-B, exploded perspective views of the 15A and 20A versions of the 250V tamper resistant electrical receptacles 10 and 10', respectively, are shown. As shown and described from the bottom up, each 250V tamper resistant electrical receptacle includes a ground strap 14-1 with assembly screws 6, which along with the one or more clips 14-24, hold the body 14 in place with the ground strap 14-1. Attachment screws 8 are shown, which can be used to attach receptacles 10 and 10' to a box, wall or other housing structure. Body 14 includes interior spaces surrounded by sidewalls or gussets (i.e., structural ribs) and a rear surface that are configured to provide the body 14 with a certain amount of structure to allow certain components fit therein (including a hot conductor that includes hot contacts 14-2 connected to a hot terminal 14-4 with a hot terminal pressure plate 14-4-1, a neutral conductor that includes neutral contacts 14-3 connected to a neutral terminal 14-5 and a neutral terminal pressure plate 14-5-1, and ground contacts 14-12) and rigidity so that it resists bending and deformation due to twisting or torsional forces.

When the electrical receptacles are assembled (absent the respective shutter assemblies 20 and 20') and the respective contacts are positioned into respective interior spaces of the body, the ground aperture 12-1 is in communication with a ground contact 14-12 formed in the ground strap 14-1, the hot aperture 12-2 is in communication with a hot contact 14-2 and the neutral aperture 12-3 is in contact with a neutral contact 14-3. When the respective shutter assemblies 20 and 20' are part of the assembled electrical receptacles, each shutter assembly is positioned between each set of hot, neutral and ground plug blade openings of the cover (12-2, 12-3, 12-1 respectively) and their corresponding hot, neutral and ground contacts (14-2, 14-3, 14-1 respectively). Each shutter assembly 20 and 20' includes one or more shutter components that are moveable with respect to a frame component 20-1 and against or with (in a direction opposite to or equal to) a bias force at least along (and in some situations, only along) a first plane, and in some cases planes that are parallel to a first plane (e.g., 20A version of the device), as is discussed further below.

Shutter assembly 20 of the 15A version of the 250V tamper resistant electrical receptacles 10 includes a frame 20-1, fixed with respect to the body portion 14, and a shutter 20-2, moveable within the receptacle 10 and with respect to frame component 20-1. Two compression springs 7 are shown positioned between portions of the frame 20-1 and the shutter 20-2. Shutter assembly 20' of the 20A version of the 250V tamper resistant electrical receptacles 10' includes a frame 20-1, fixed with respect to the body portion 14, and two shutters 20-2-1 and 20-2-2. The shutters 20-2-1 and 20-2-2 are moveable within the receptacle 10', with respect to each other and with respect to frame component 20-1 (which is fixed with respect to the body 14). Two compression springs 7 are shown positioned between portions of the frame 20-1 and the shutter 20-2-1. A cover 12 is secured over the top of the respective shutter assemblies 20 and 20'.

Cover 10 can be made from, for example, nylon 6. Shutter assembly 20 and 20' components can be made from, for example, a medium viscosity acetal homopolymer such as Delrin® 500P material. Frame 20-1 can be made from, for example, polycarbonate.

Figure 6:
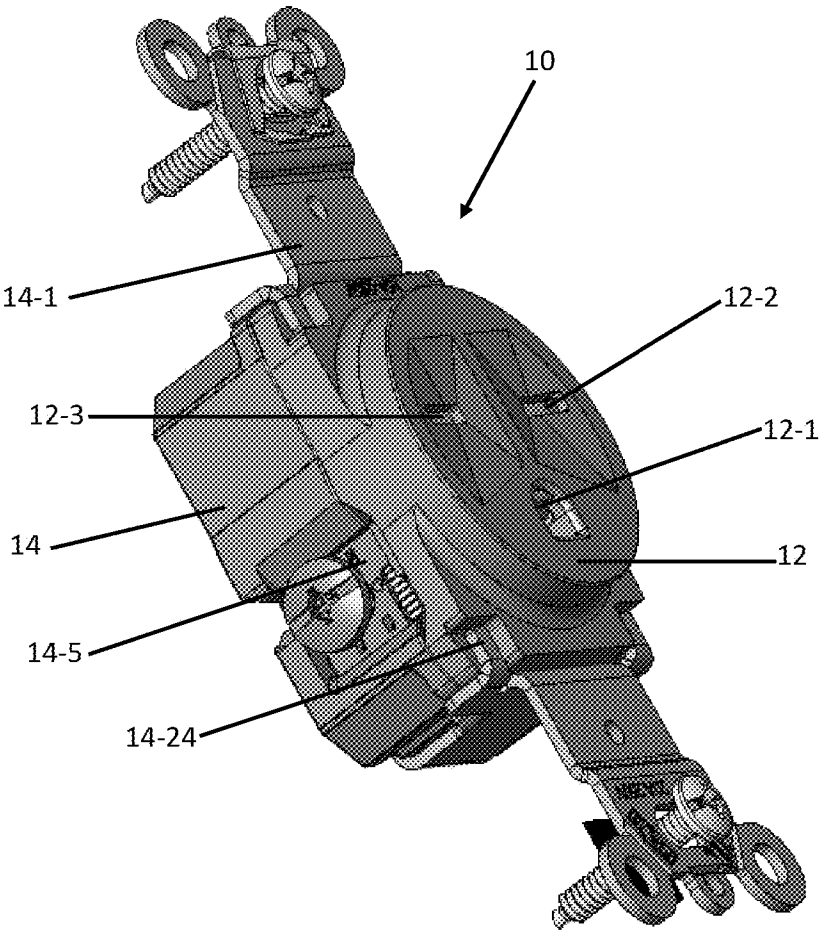
FIG. 6 is a front left side perspective view of a tamper resistant electrical receptacle according to the embodiment shown in FIG. 1.
Figure 7:
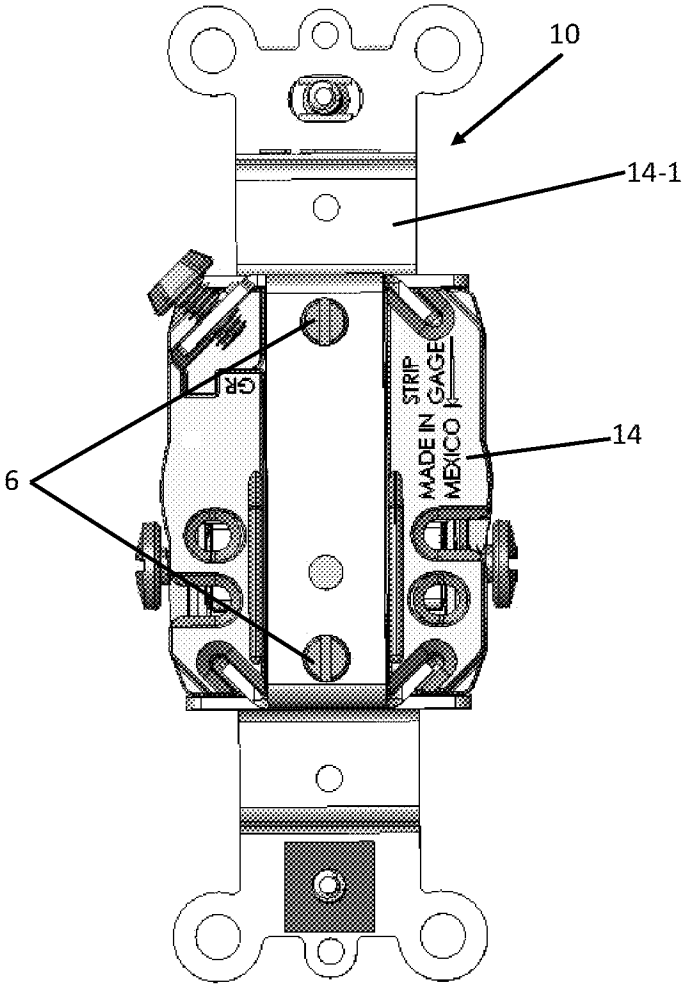
FIG. 7 is a back view of a tamper resistant electrical receptacle according to the embodiment shown in FIG. 1.

Turing to FIGS. 6-7, front left side perspective and back views of the 15A version of a 250V tamper resistant electrical receptacle 10, respectively, are shown.

Figure 8A:
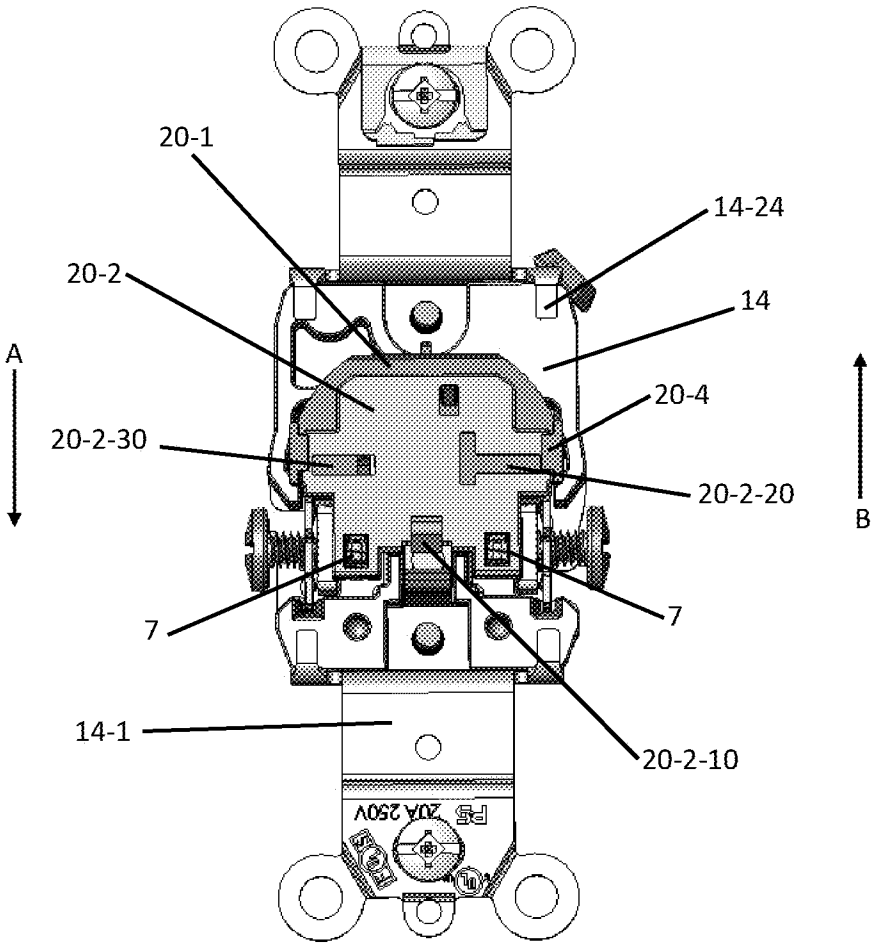
FIG. 8A is a front view of a tamper resistant electrical receptacle with certain components removed according to the embodiment shown in FIG. 1.

Turning to FIG. 8A, a front view of the 15A version of a 250V tamper resistant electrical receptacle 10 is shown with the cover 12 removed to show the shutter assembly 20 and frame 20-1 positioned over and within body 14. Shutter 20-2 is shown in a blocking position, blocking openings 20-1-2 and 20-1-3 in the frame 20-1 and, thus, blocking access to the hot contacts 14-2 and neutral contacts 14-3, respectively. Springs 7 bias shutter 20-2 to the blocking position via force arrow A, which is held adjacent to frame 20-1 by clips 20-4, when no external force is applied to the shutter 20-2. In order to overcome the bias force exerted by the springs 7, a ground prong of a corded plug is inserted through ground prong aperture 12-1 (not shown), to contact ramp 20-2-10 of shutter 20-2 and move shutter 20-2 along a first plane in the direction of force arrow B as the force of the action of the ground prong (in the direction through the page) on the ramp 20-2-10 overcomes force A of springs 7. The movement of the shutter 20-2 in direction of force arrow B to an open position exposes openings 20-1-3, 20-1-2 and 20-1-1 of the frame, providing access to the neutral contacts 14-3, hot contacts 14-2, and ground contacts 14-12, respectively, for the blades/prongs of the corded plug to contact (see FIG. 11). Movement of the shutter 20-2 is in and along a single plane via force A or B (clips 20-4 create channels for side portions of the shutter 20-2 to slide within and along the first plane). When the ground prong of a corded plug is removed, force A exerted by springs 7 moves the shutter 20-2 along the first plane and back to the blocking position.

Figure 8B:
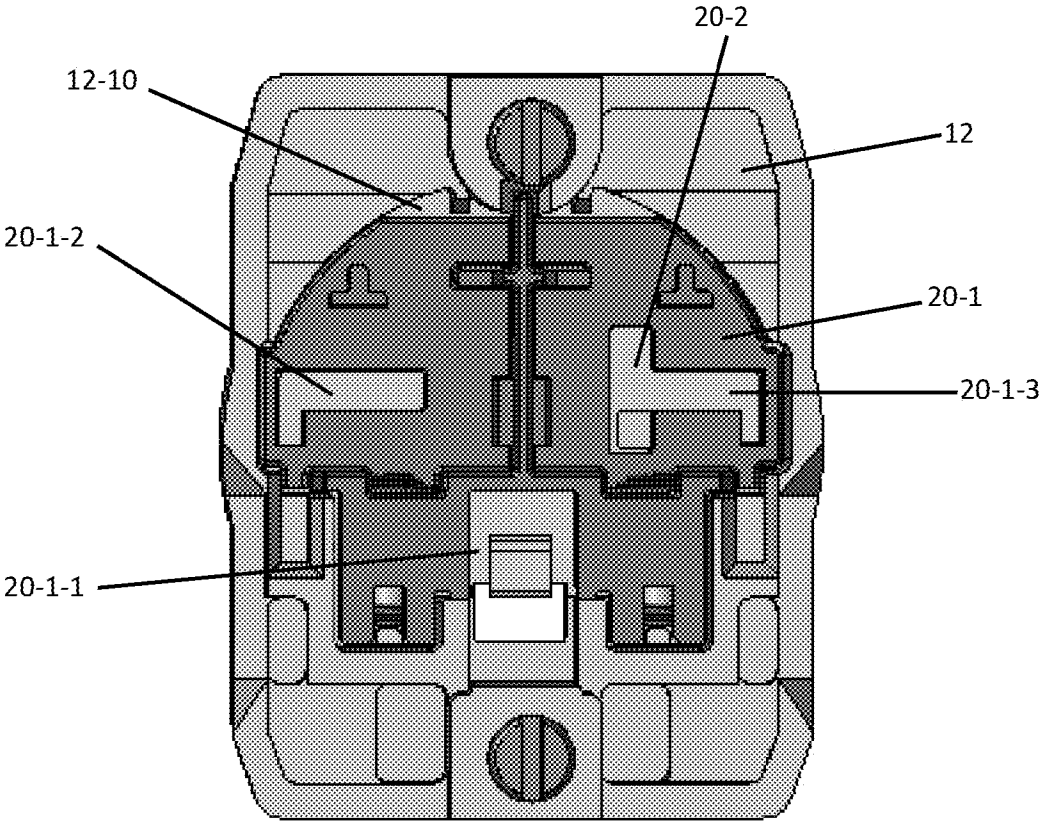
FIG. 8B is a back side view of the cover with the shutter assembly positioned therein of a tamper resistant electrical receptacle according to the embodiment shown in FIG. 1.

Referring to FIG. 8B, a back side view of the cover 12 with the shutter assembly 20 is shown. As shown, the shutter assembly 20 is positioned in a recessed space 12-10 formed and configured to fit the shuttle assembly 20. Portions of the shutter 20-2 can be seen through frame openings 20-1-2 and 20-1-3.

Figure 9:
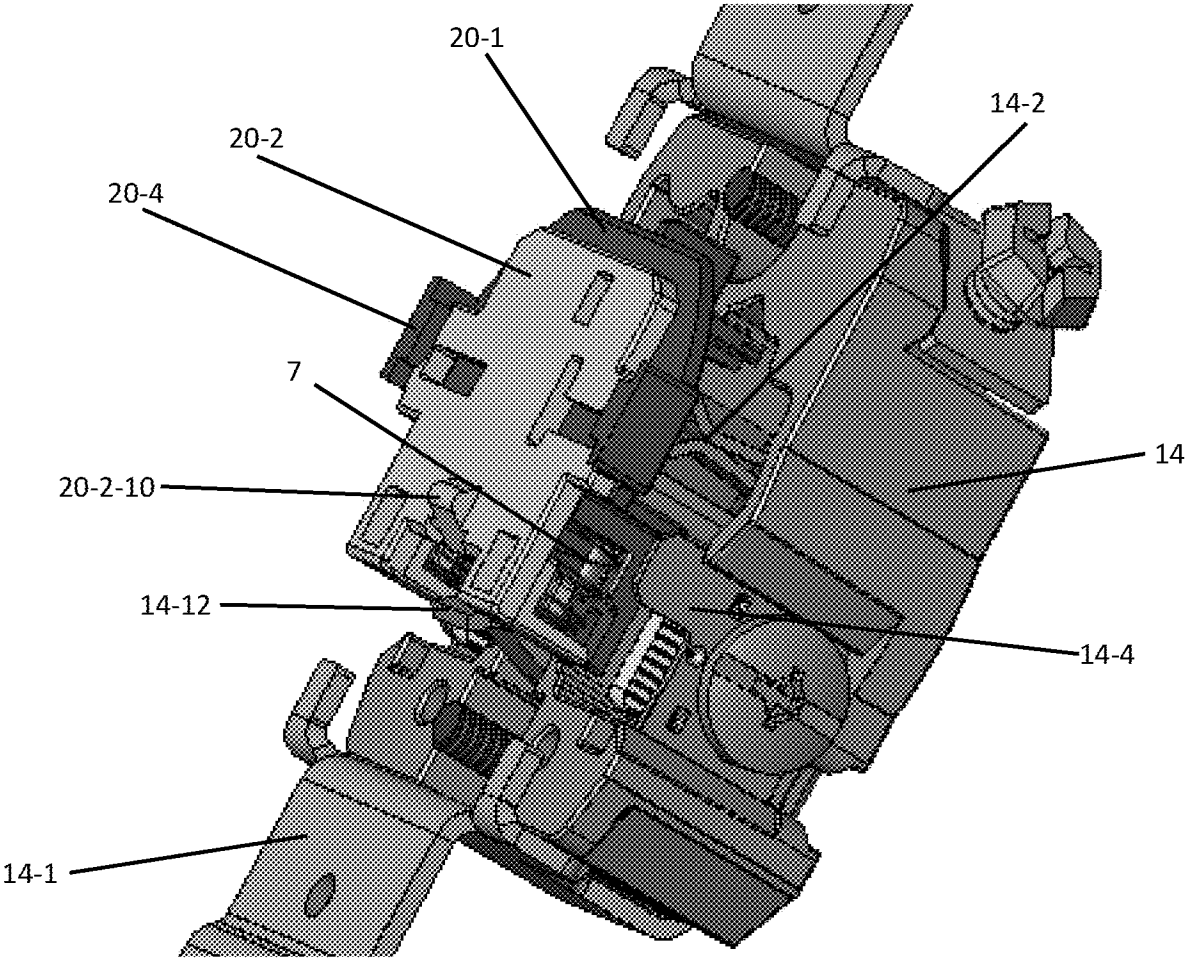
FIG. 9 is a front right side perspective views of a tamper resistant electrical receptacle with certain components removed according to the embodiment shown in FIG. 1.
Figure 10A:
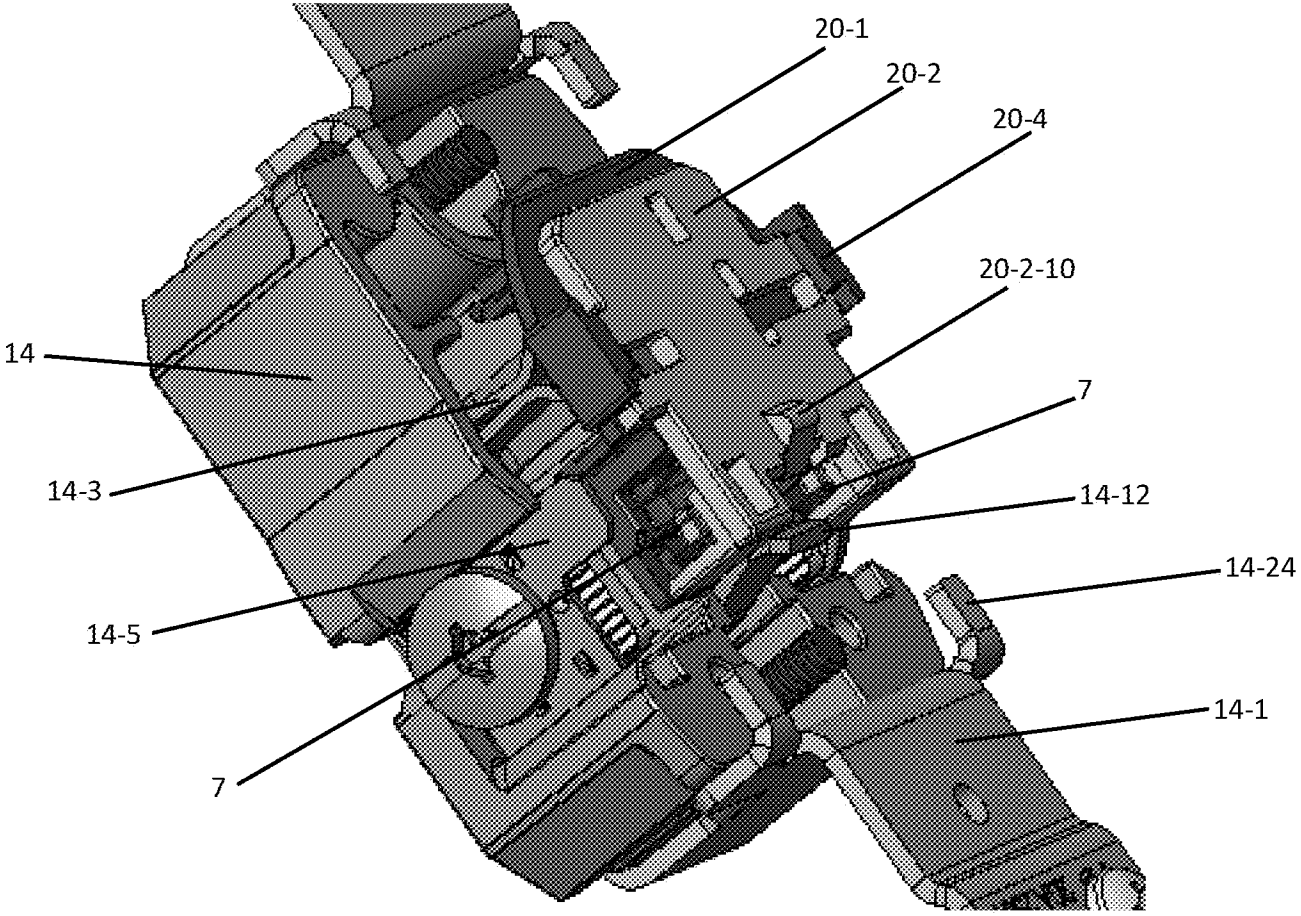
FIG. 10A is a front left side perspective views of a tamper resistant electrical receptacle with certain components removed according to the embodiment shown in FIG. 1.

Turning to FIGS. 9 and 10A, front right side and front left side perspective views of the 15A version of a 250V tamper resistant electrical receptacle 10 with the cover 12 removed, respectively, are shown.

Figure 10B:
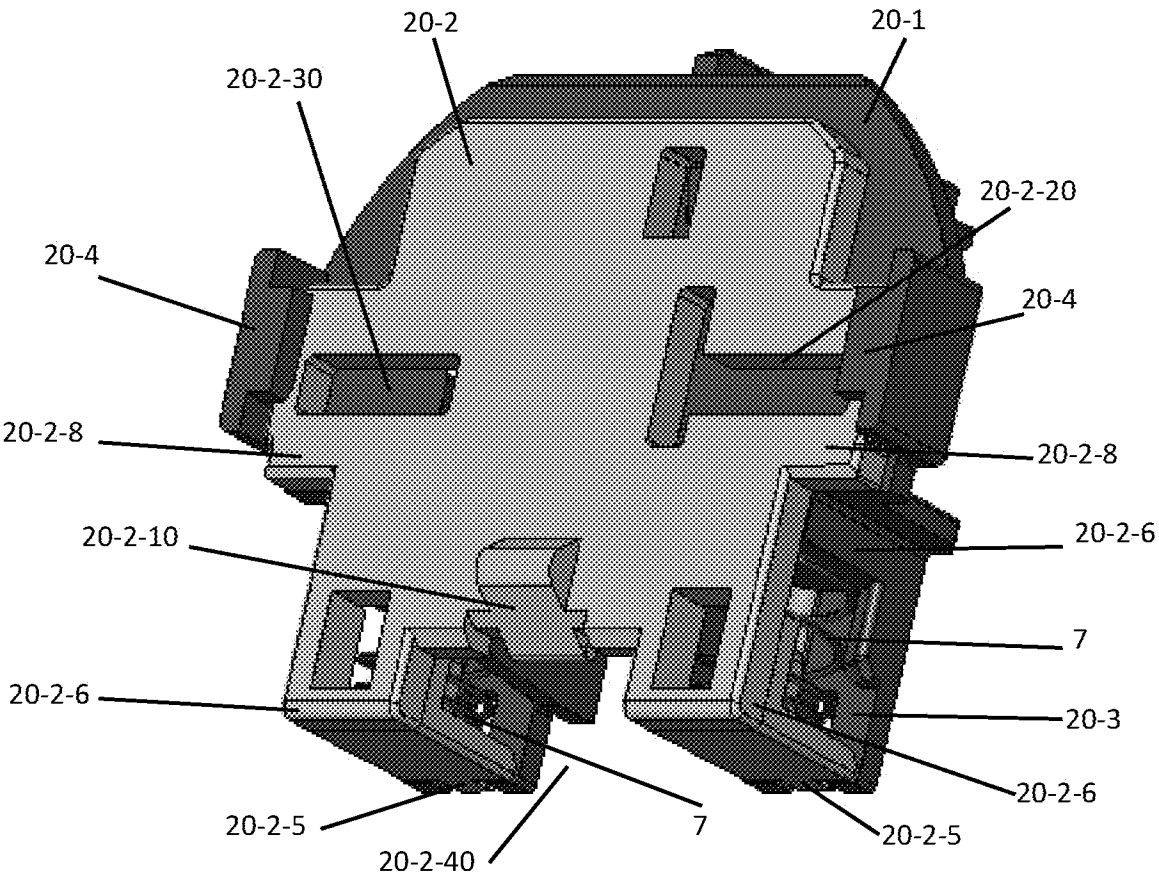
FIG. 10B is a front perspective view of the shutter assembly of a tamper resistant electrical receptacle according to the embodiment shown in FIG. 1.
Figure 10C:
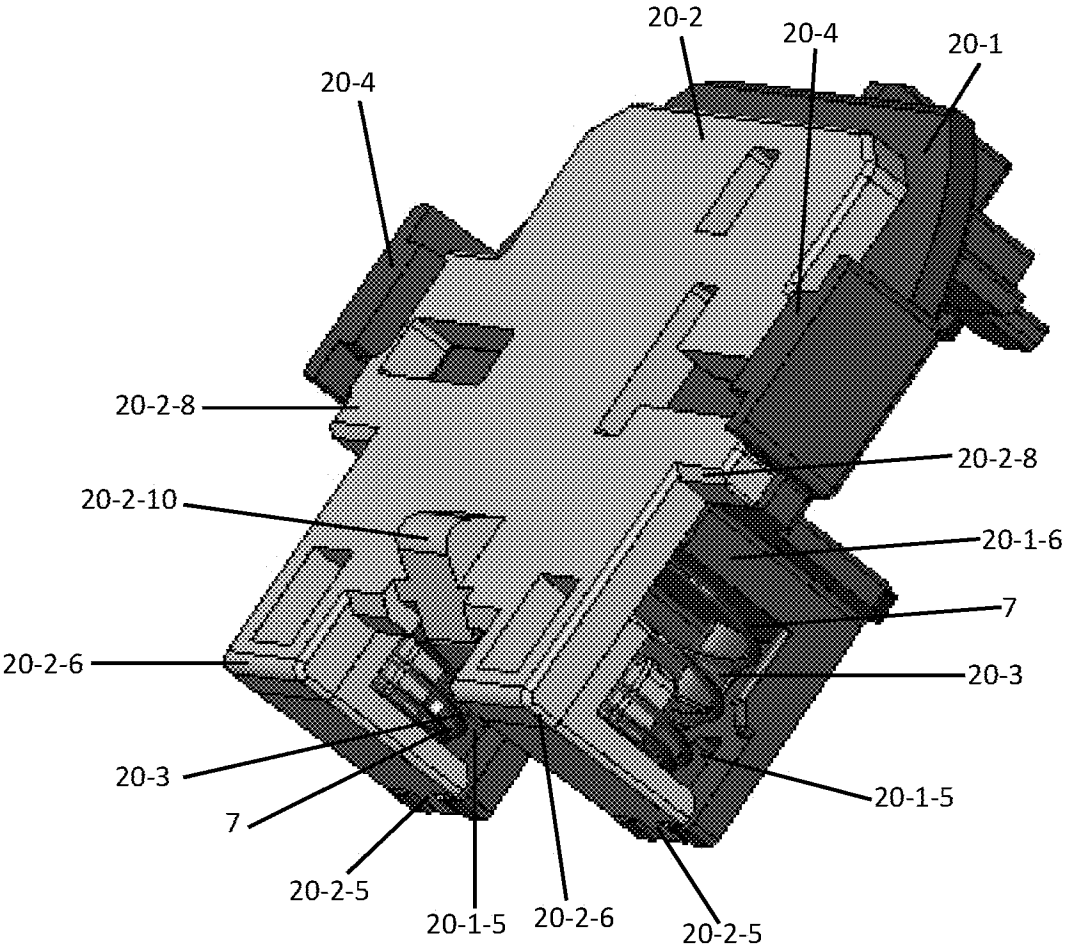
FIG. 10C is a front right side perspective view of the shutter assembly of a tamper resistant electrical receptacle according to the embodiment shown in FIG. 1.
Figure 10D:
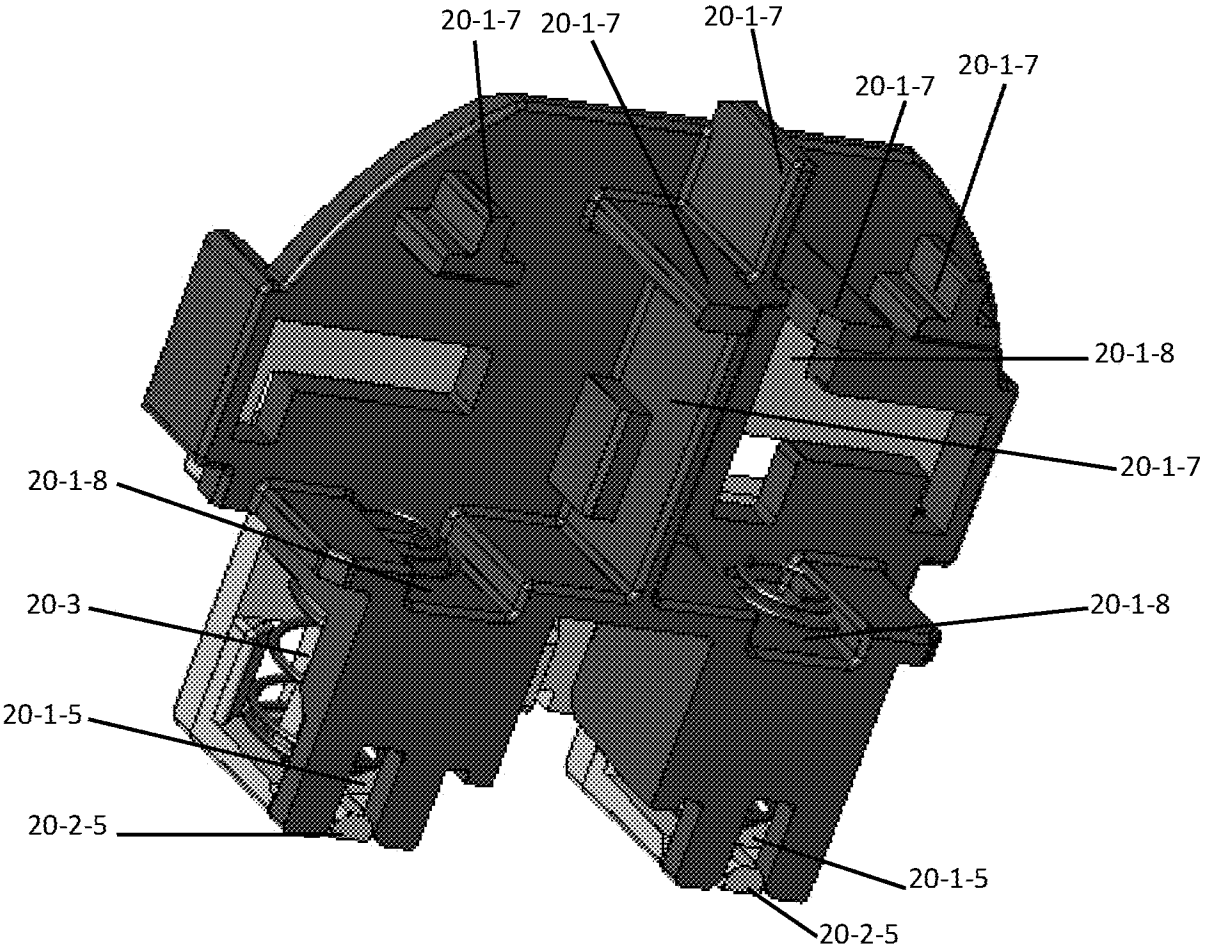
FIG. 10D is a back side perspective view of the shutter assembly of a tamper resistant electrical receptacle according to the embodiment shown in FIG. 1.

Turning to FIGS. 10B-D, front perspective, front right side perspective, and back side perspective views of the shutter assembly 20 of the 15A version of a 250V tamper resistant electrical receptacle 10, respectively, are shown. Among other elements, the shutter 20-2 and springs 7 are shown assembled together with frame 20-1. Shutter 20-2 is shown with side arms 20-2-8, which are positioned and moveable along the first plane in the direction of force arrow A and in the direction of force arrow B (as previously defined, above) within channels formed by the top surface of the frame 20-1 and the bottom surface of each clip 20-4. Shutter 20-2 includes two legs that form L-shaped portions 20-2-6, and frame 20-1 includes two legs that form opposite and complimentary L-shaped portions 20-2-6. These complimentary L-shaped portions form "box" shapes with spaces 20-3 that house springs 7. The distal end 20-2-5 of each shutter leg includes a protrusion that fits within a channel/longitudinal opening 20-1-5 formed in the distal end of each frame leg (the positioning of the protrusion and channel/longitudinal opening can be reversed; the longitudinal opening does not need to be an opening, it can be a recessed channel; the protrusion can be a wheel, for example). These complimentary features confirm a steady structure while promoting movement in the identified directions. As shown through shutter blade holes 20-2-30 and 20-2-20 in FIG. 10B (and in FIG. 8B), frame 20-1 blocks access to the hot contacts 14-2 and neutral contacts 14-3. As shown in FIG. 10D, various ribs/walls 20-1-7 and spaces 20-1-8 are illustrated on the back side of the frame 20-1. These ribs/walls 20-1-7 and spaces 20-1-8 are structured and configured to fit and secure the frame 20-1 to the body 14.

Figure 11:
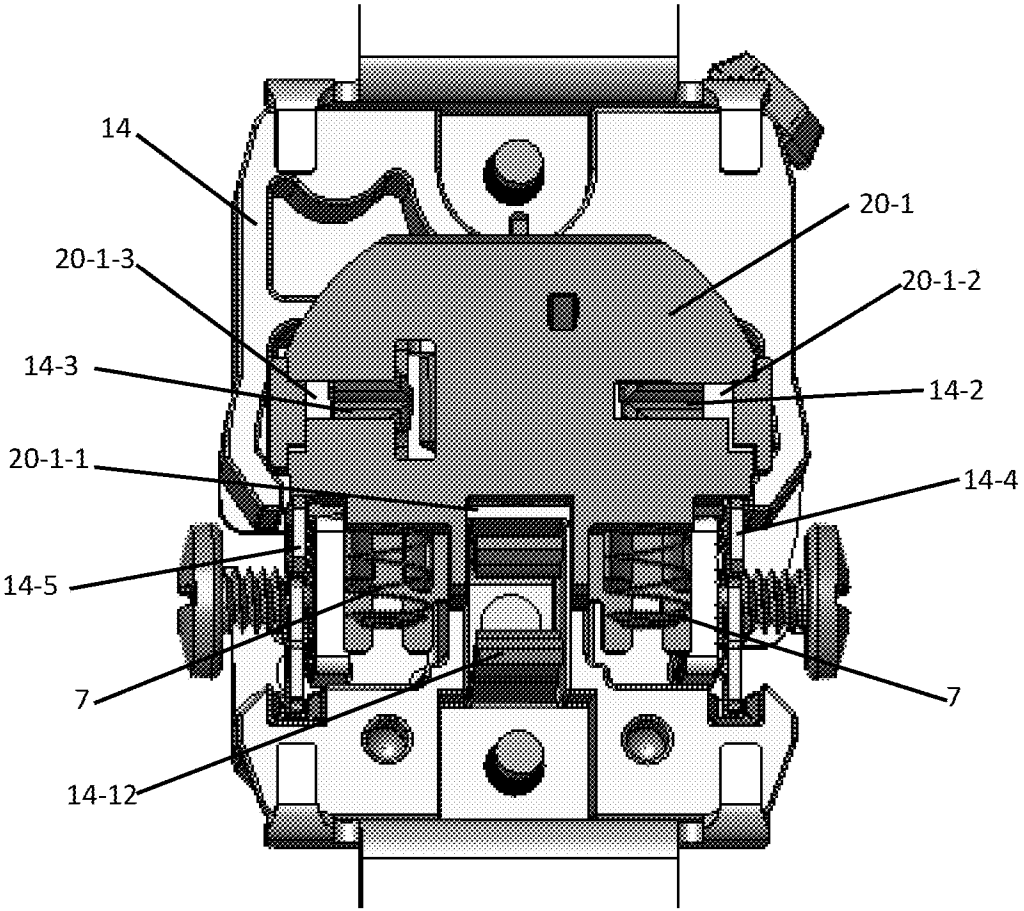
FIG. 11 is a front view of a tamper resistant electrical receptacle with certain components removed according to the embodiment shown in FIG. 1.

Referring to FIG. 11, a front view of the 15A version of a 250V tamper resistant electrical receptacle 10 is shown with the cover 12 and shutter 20-2 removed to show the frame 20-1 positioned over and within body 14. Openings 20-1-3 and 20-1-2 are shown exposed without the shutter 20-2 being present, and the hot contacts 14-2 and neutral contacts 14-3 are exposed.

Figure 12A:
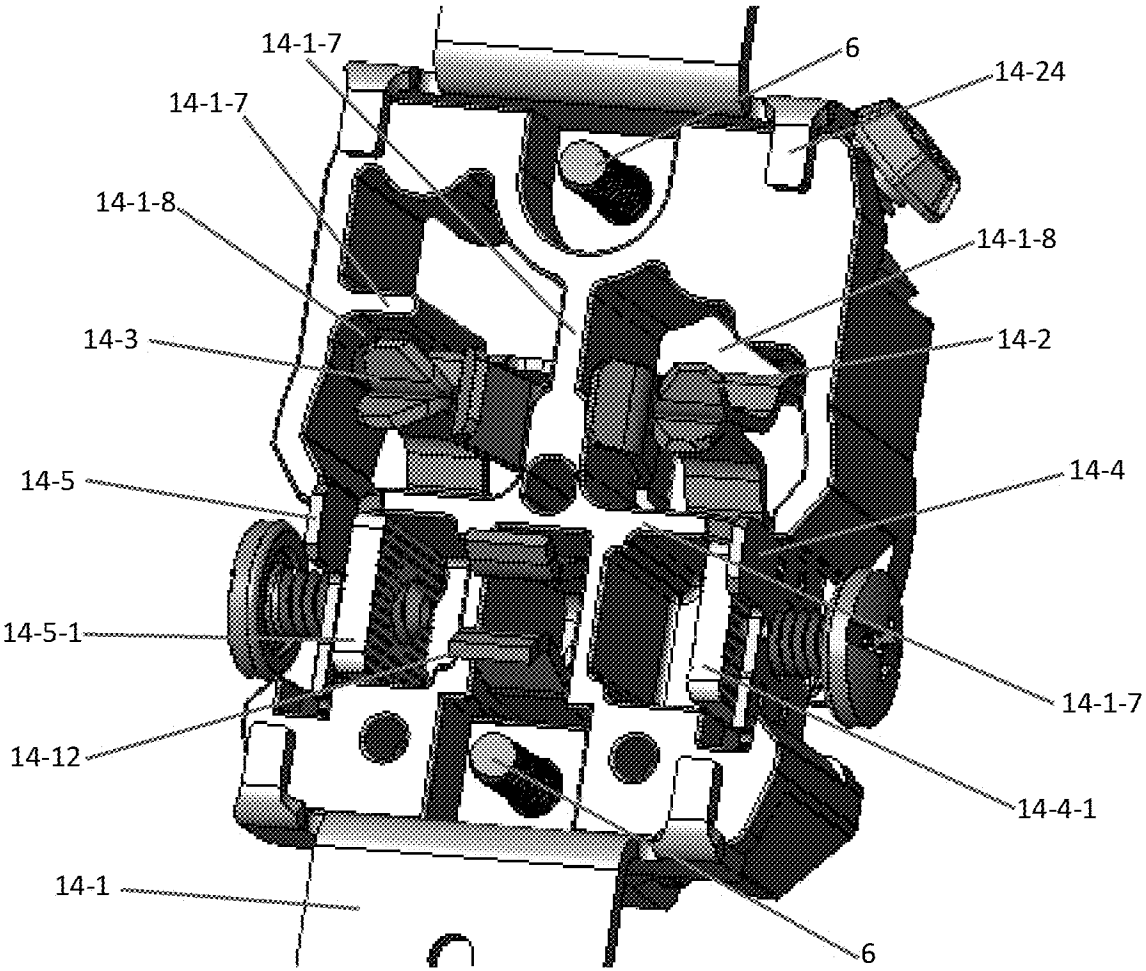
FIG. 12A is a front perspective view of a tamper resistant electrical receptacle with certain components removed according to the embodiment shown in FIG. 1.
Figure 12B:
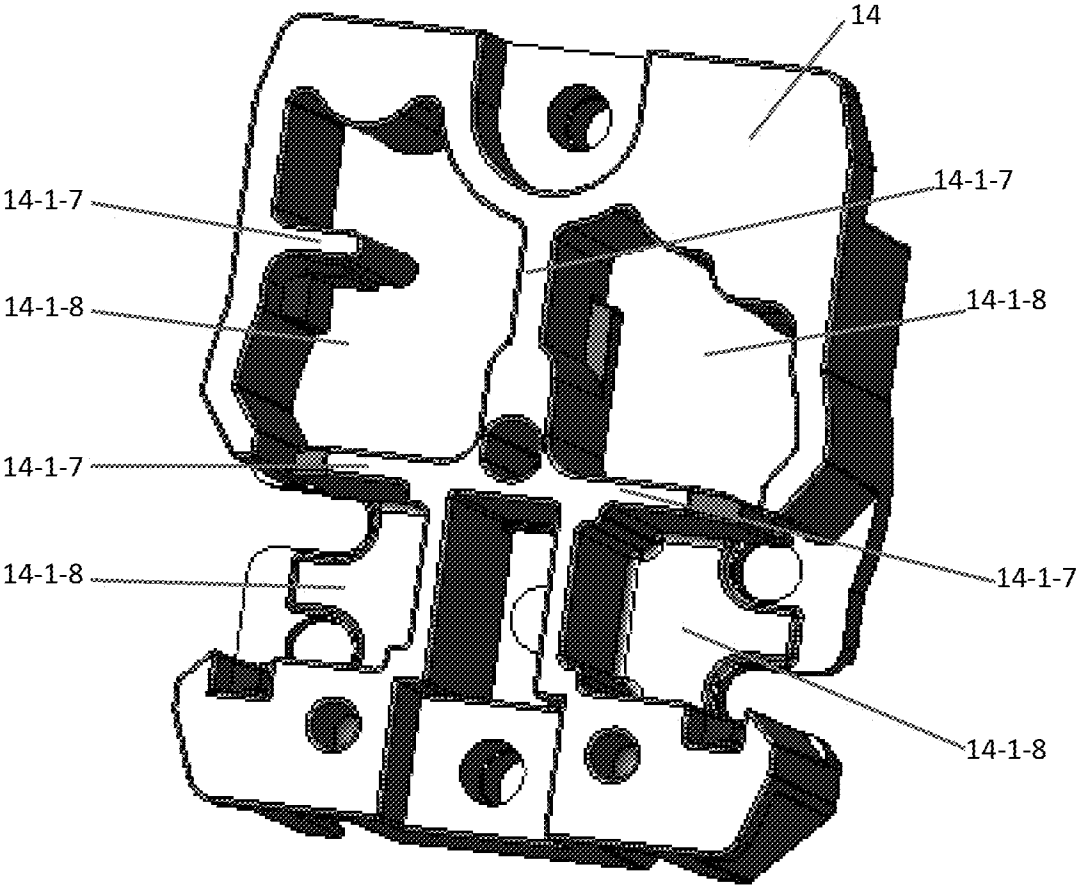
FIG. 12B is a front perspective view of a tamper resistant electrical receptacle with certain components removed according to the embodiment shown in FIG. 1.

Turning to FIG. 12A, a front perspective view of the 15A version of a 250V tamper resistant electrical receptacle 10 is shown with the cover 12, shutter assembly 20/frame 20-1 removed to show the body 14 positioned on the ground strap 14-1. FIG. 12B is a front perspective view of the body 14. Various ribs/walls 14-1-7 and spaces 14-1-8 are illustrated on the front side of the body 14. These ribs/walls 14-1-7 and spaces 14-1-8 are structured and configured to fit and secure the frame 20-1 to the body 14, and to house hot contact 14-2, neutral contacts 14-3, ground contacts 14-12, hot terminal pressure plate 14-4-1 and hot terminal 14-4, and neutral terminal pressure plate 14-5-1 and neutral terminal 14-5.

Figure 13:
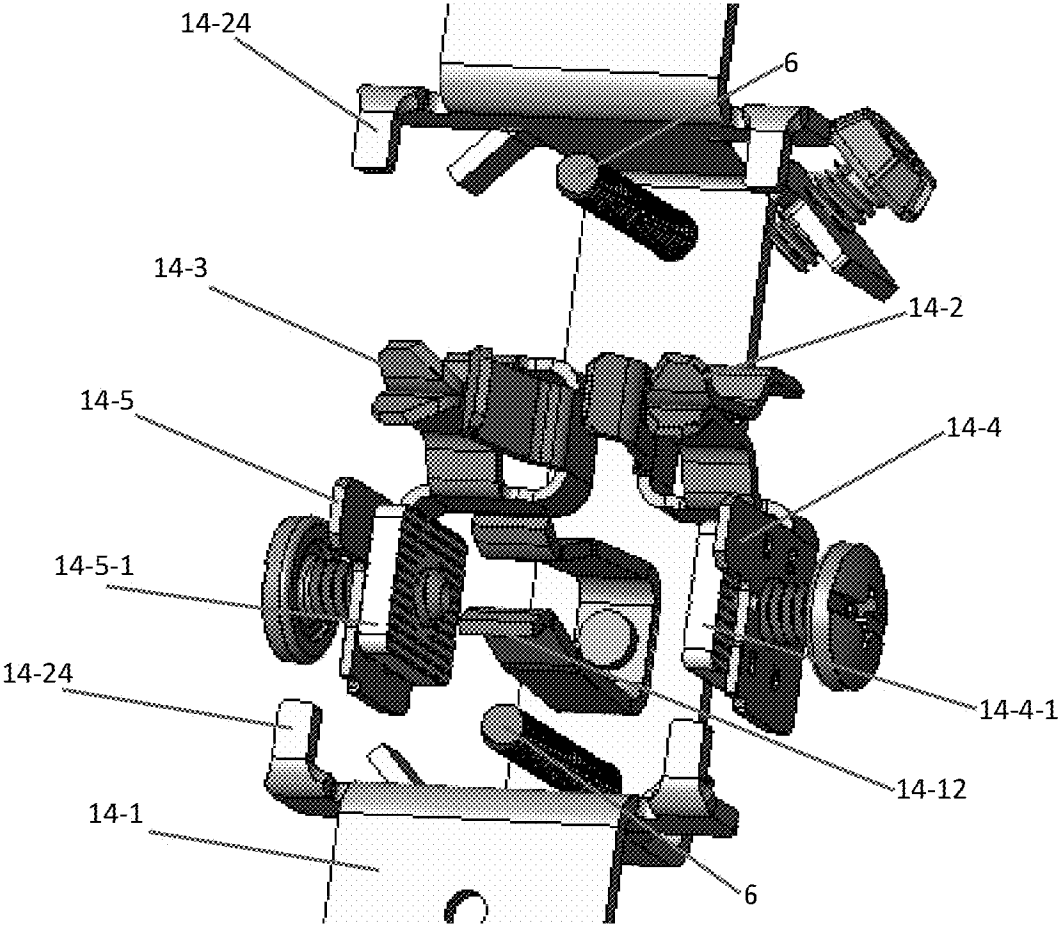
FIG. 13 is a front perspective view of a tamper resistant electrical receptacle with certain components removed according to the embodiment shown in FIG. 1.

Referring to FIG. 13, a front perspective view of the 15A version of a 250V tamper resistant electrical receptacle 10 is shown with the cover 12, shutter assembly 20/frame 20-1 and body 14 removed to show the positioning of the electrical contacts and terminals with respect to the ground strap 14-1.

FIGS. 12A, 12B and 13 are equally applicable to and equally disclose certain components of the 20A version of a 250V tamper resistant electrical receptacle 10', as these figures illustrate and disclose the non-shutter assembly/cover and frame related components.

FIGS. 14-21 relate to the 20A version of the 250V tamper resistant electrical receptacle 10'. Some of these Figures are similar to Figures discussed above with respect to the 15A version of the 250V tamper resistant electrical receptacle 10, and the same should be clear or will be so noted. A majority of the elements are the same or similar, and will not be further discussed where they have already been discussed and/or highlighted with respect to the 15A version 10 (the discussion of which above applies equally to the 20A device 10'). The main differences between the two receptacles 10 and 10' are related to the shutter assemblies 20 and 20'.

Figure 14:
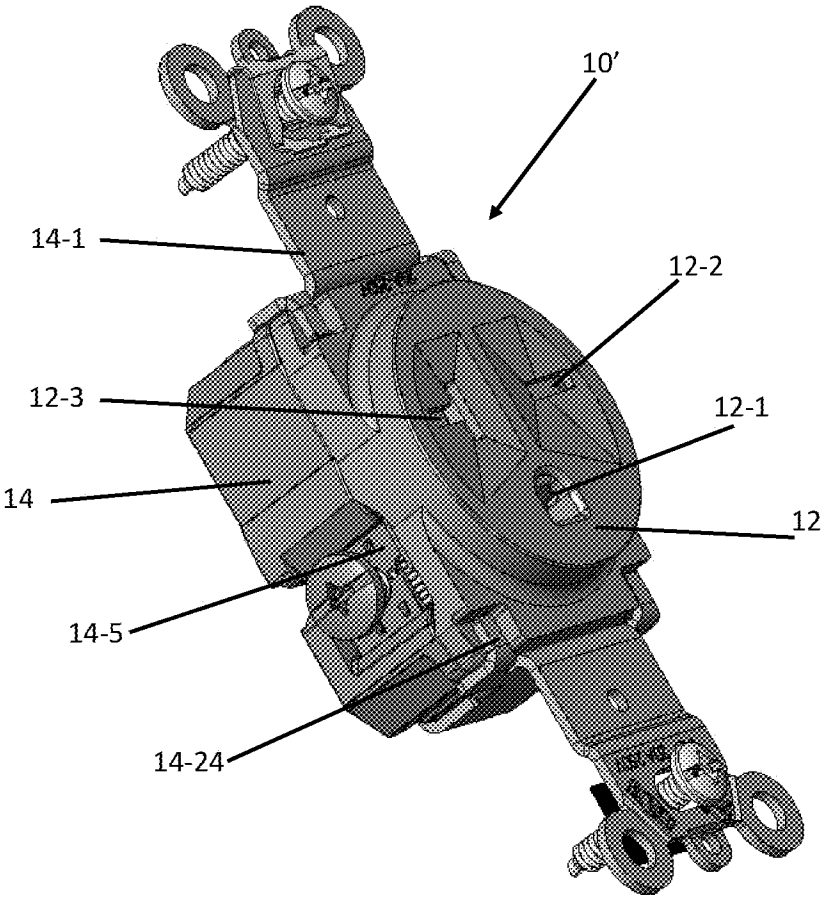
FIG. 14 is a front left side perspective view of a tamper resistant electrical receptacle according to the embodiment shown in FIG. 3.
Figure 15A:
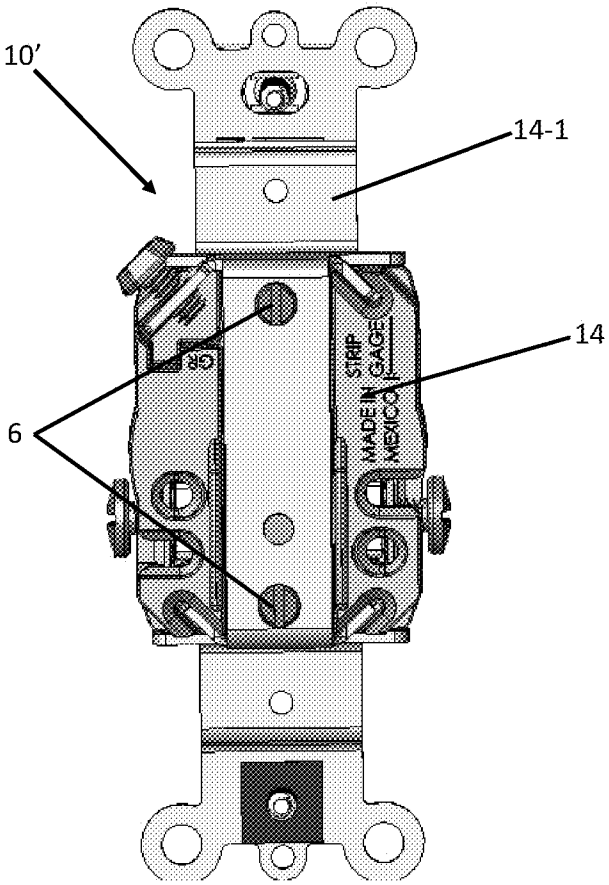
FIG. 15A is a back view of a tamper resistant electrical receptacle according to the embodiment shown in FIG. 3.

Turning to FIGS. 14 and 15A, front left side perspective and back views of the 20A version of a 250V tamper resistant electrical receptacle 10', respectively, are shown. These Figures are similar to the embodiment shown in and described with respect to FIGS. 6-7.

Figure 15B:
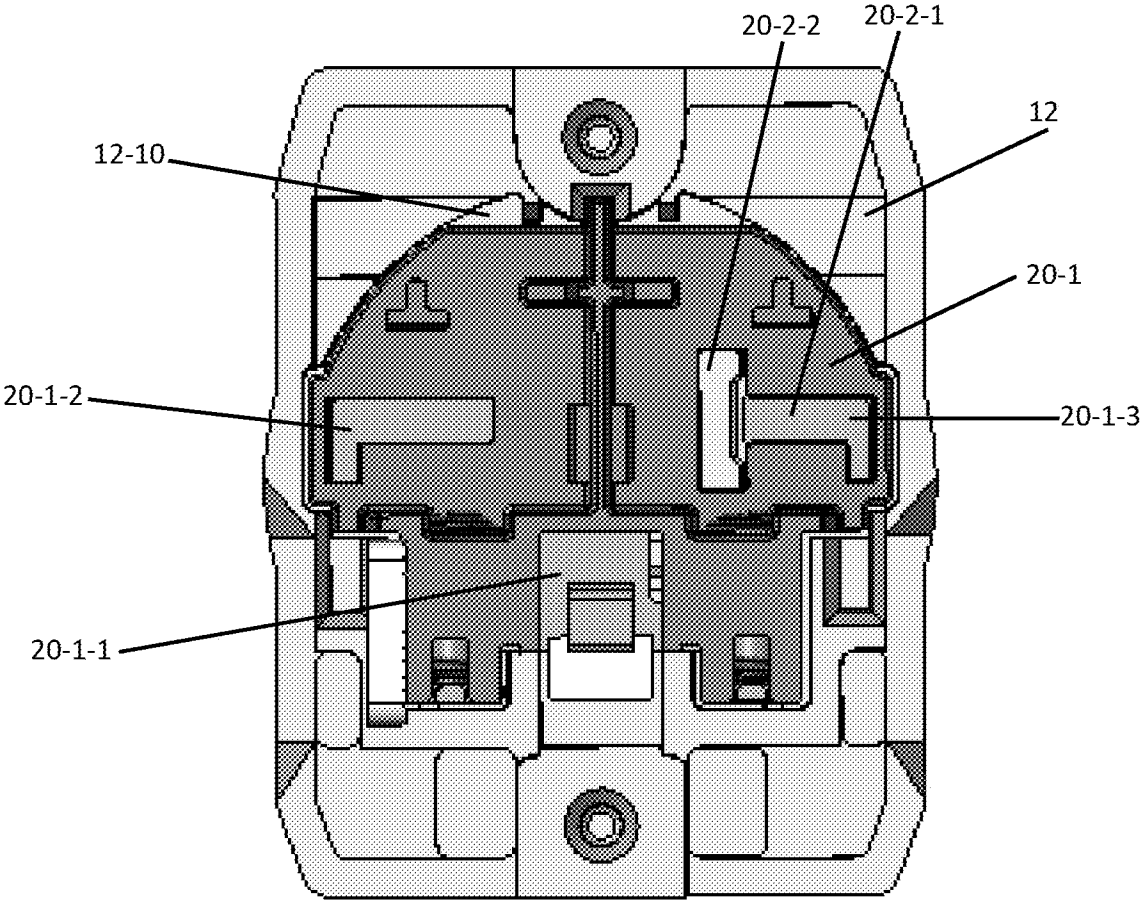
FIG. 15B is a back side view of the cover with the shutter assembly positioned therein of a tamper resistant electrical receptacle according to the embodiment shown in FIG. 3.

Referring to FIG. 15B, a back side interior view of the cover 12 with the shutter assembly 20' is shown. As shown, the shutter assembly 20' is positioned in a recessed space 12-10 formed and configured to fit the shuttle assembly 20'. This Figure is similar to FIG. 8B. However, in FIG. 15B, portions of both shutters 20-2-2 and 20-2-1 can be seen through frame opening 20-1-3.

Figure 16:
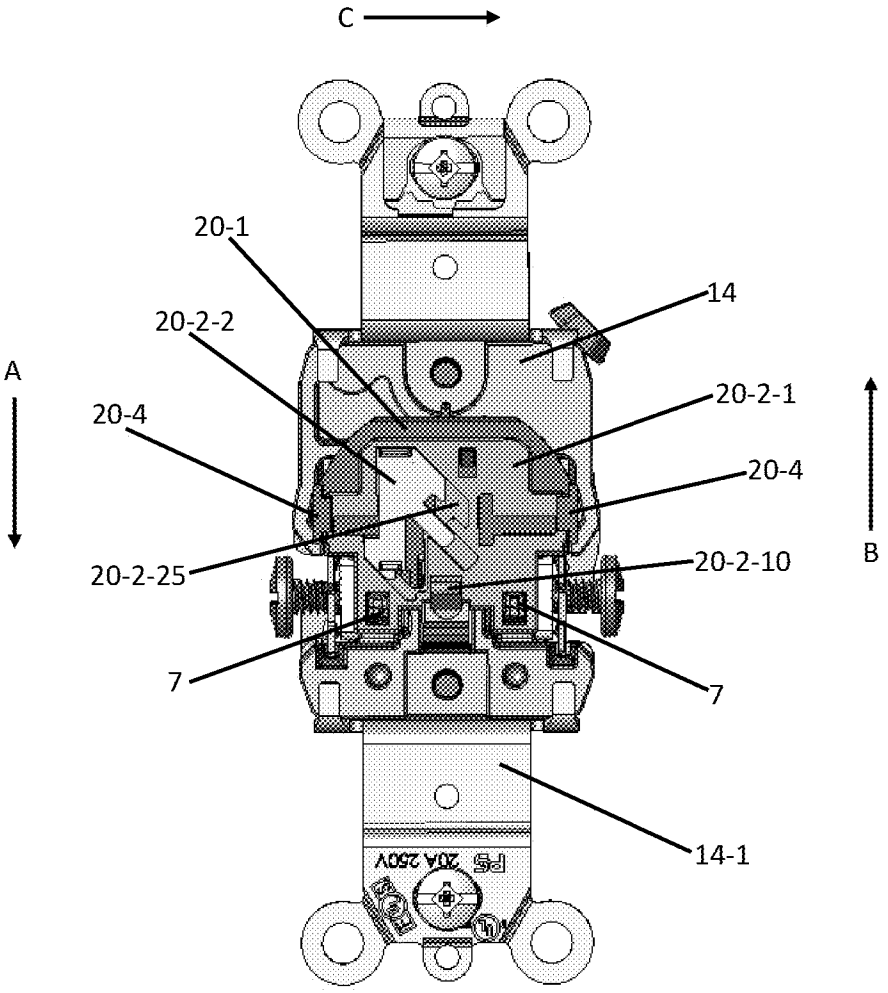
FIG. 16 is a front view of a tamper resistant electrical receptacle with certain components removed according to the embodiment shown in FIG. 3.

Turning to FIG. 16, a front view of the 20A version of a 250V tamper resistant electrical receptacle 10' is shown with the cover 12 removed to show the shutter assembly 20' and frame 20-1 positioned over and within body 14. Shutter assembly 20' includes shutter 20-2-2 positioned in recess 20-2-25 of shutter 20-2-1. Shutter assembly 20' is shown in a blocking position, blocking openings 20-1-2 and 20-1-3 in the frame 20-1 and thus access to the hot contacts 14-2 and neutral contacts 14-3, respectively. Springs 7 bias shutter assembly 20' to the blocking position via force arrow A, which is held adjacent to frame 20-1 by clips 20-4. In order to overcome the bias force exerted by the springs 7, a ground prong of a corded plug is inserted through ground prong aperture 12-1 (not shown), to contact ramp 20-2-10 of shutter 20-2-1 and move shutter 20-2-1 along a first plane in the direction of force arrow B as the force of the action of the ground prong on the ramp 20-2-10 overcomes force A of springs 7. The movement of the shutter 20-2-1 in direction of force arrow B forces shutter 20-2-2 to move along a separate but parallel plane (as compared with the plane within which shutter 20-2-1 moves) within recess 20-2-25. Recess 20-2-25 is formed at an angle to a longitudinal access of receptacle 10 (down and to the right), as shown in FIG. 16. Since shutter 20-2-1 is moving in the direction of force arrow B at the same time that shutter 20-2-2 is moving along angled recess 20-2-25, the resulting relative movement of shutter 20-2-2 is substantially or completely in the direction of arrow C with respect to the remainder of receptacle 10'. The movement of shutter 20-2-1 and shutter 20-2-2 to the open position exposes openings 20-1-3, 20-1-2 and 20-1-1 of the frame, providing access to the neutral contacts 14-3, hot contacts 14-2, and ground contacts 14-12, respectively, for the blades/prongs of the corded plug to contact (see FIG. 21). Movement is in a single plane via force A, B, and as controlled by recess 20-2-25 (clips 20-4 create channels for side portions of the shutter 20-2 to slide within and along the first plane). When the ground prong of a corded plug is removed, force A exerted by springs 7 moves the shutter 20-2-1 along the first plane back to the blocking position as shutter 20-2-2 is moved back along recess 20-2-25 (up and to the left) to the blocking position.

Figure 17A:
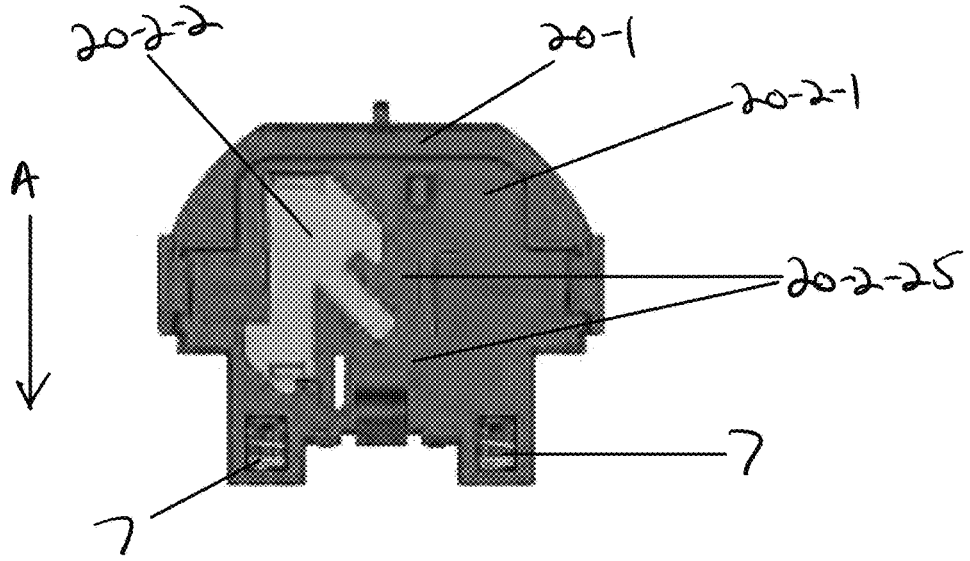
FIG. 17A is a front view of a shutter assembly of a tamper resistant electrical receptacle according to the embodiment shown in FIG. 3.
Figure 17B:
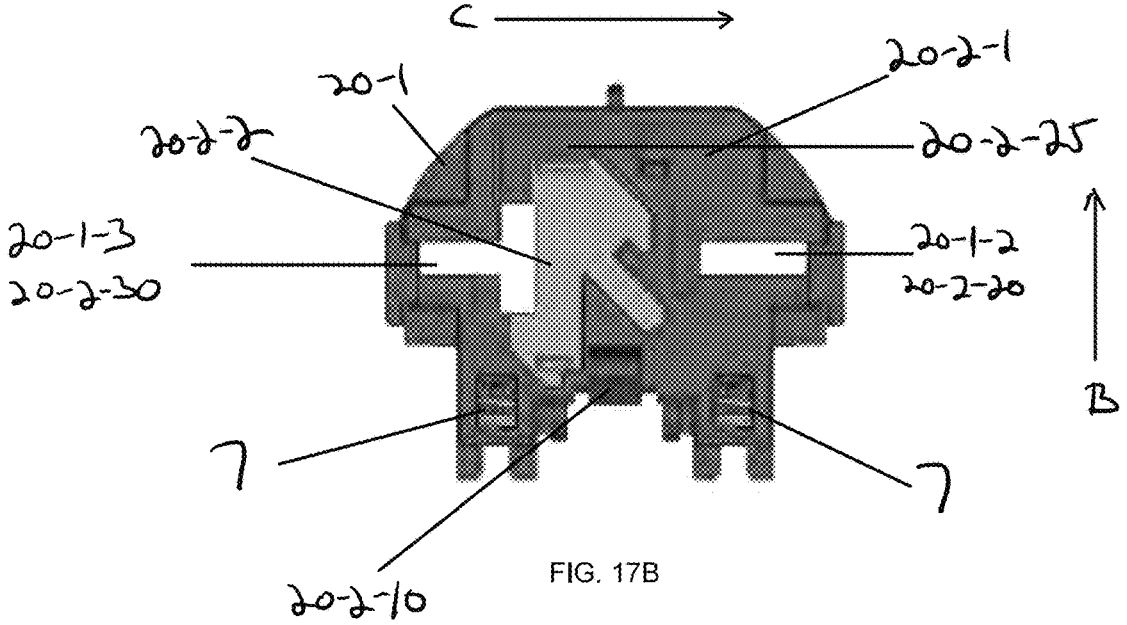
FIG. 17B is a front view of a shutter assembly of a tamper resistant electrical receptacle according to the embodiment shown in FIG. 3.

Turning to FIGS. 17A and 17B, front views of the shutter assembly 20' of the 20A version of a 250V tamper resistant electrical receptacle 10' are shown. FIG. 17A shows the shutter assembly 20' in a blocking position. FIG. 17B shows the shutter assembly 20' in an open position.

Figure 17C:
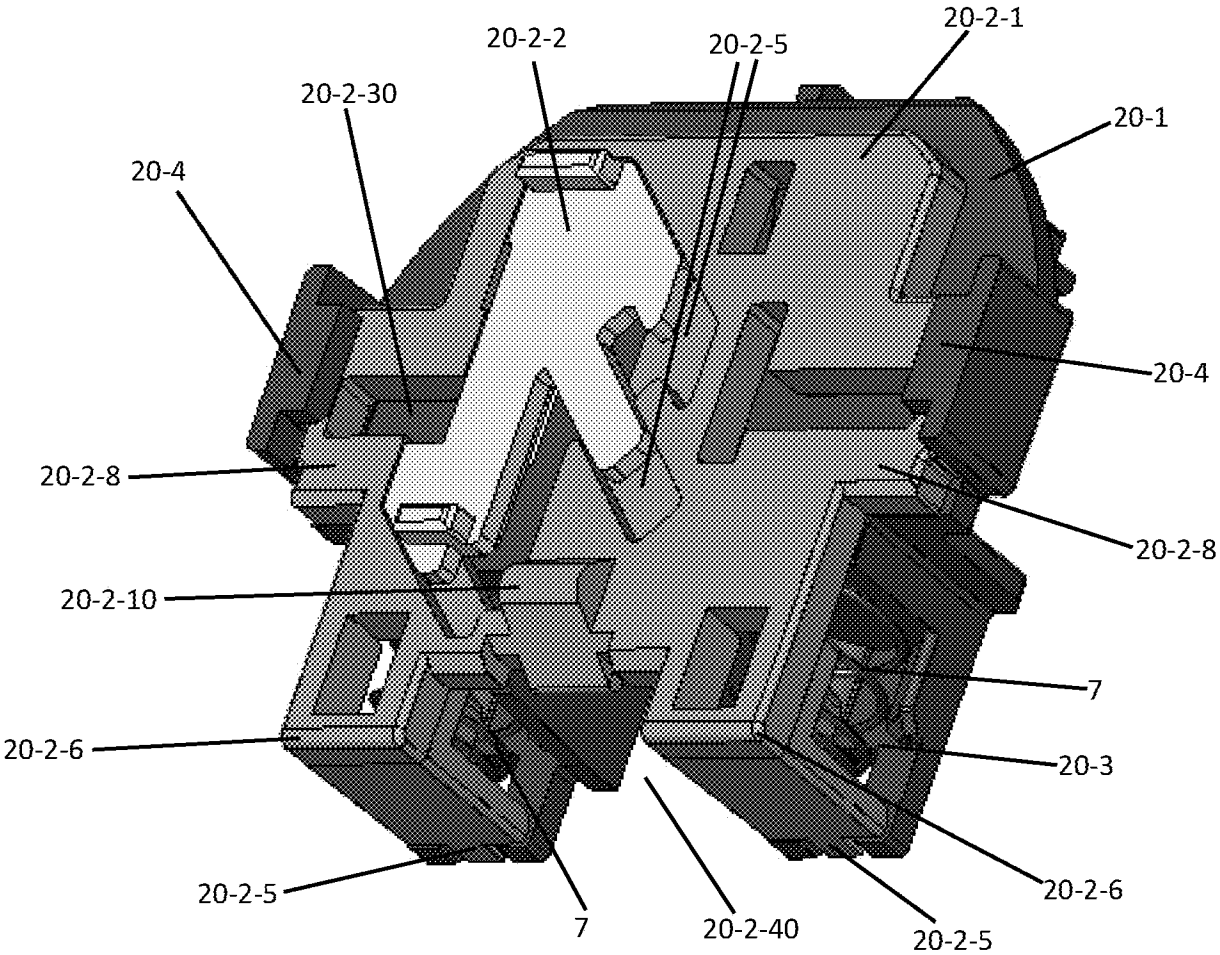
FIG. 17C is a front perspective view of the shutter assembly of a tamper resistant electrical receptacle according to the embodiment shown in FIG. 3.
Figure 17D:
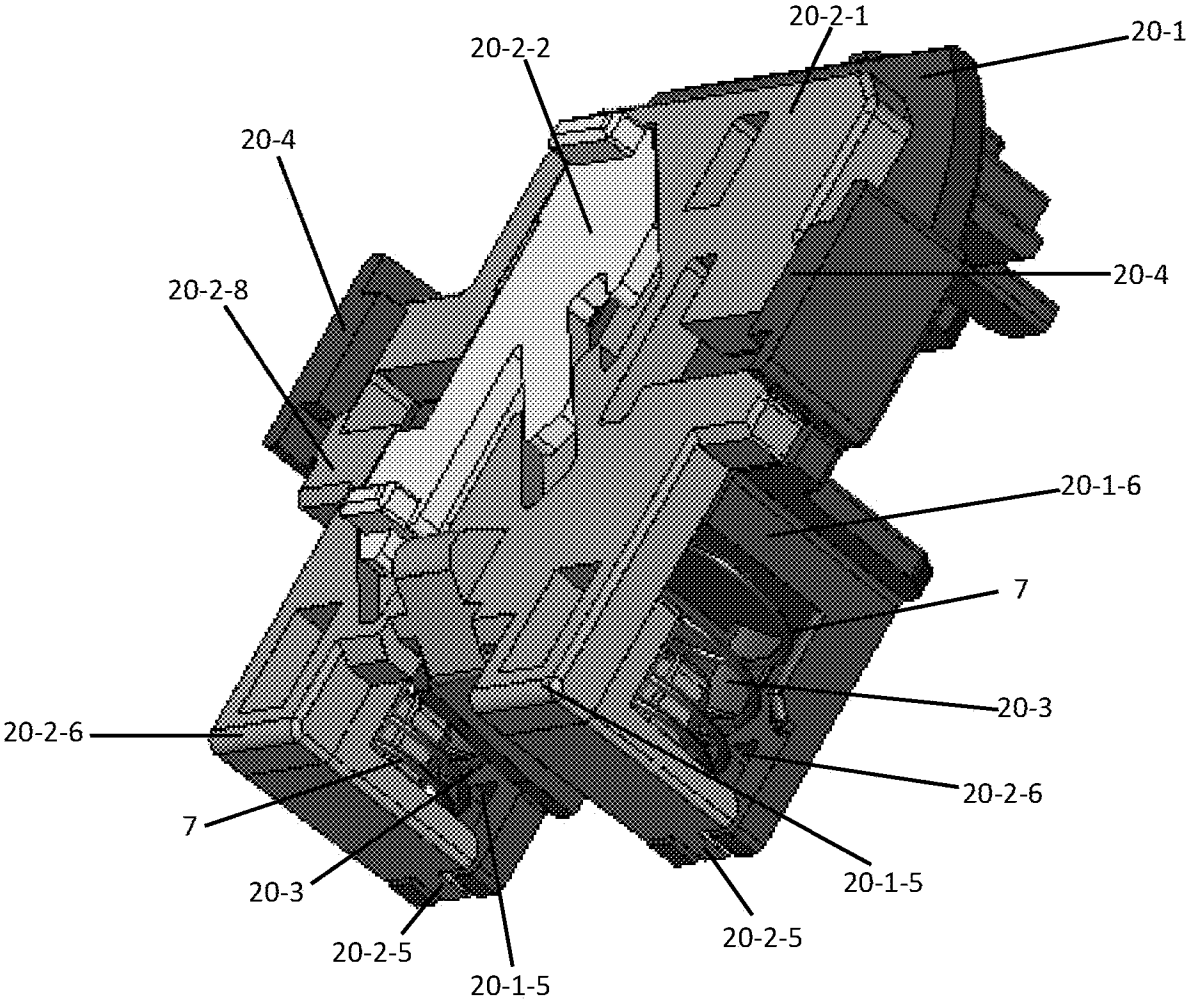
FIG. 17D is a front right side perspective view of the shutter assembly of a tamper resistant electrical receptacle according to the embodiment shown in FIG. 3.
Figure 17E:
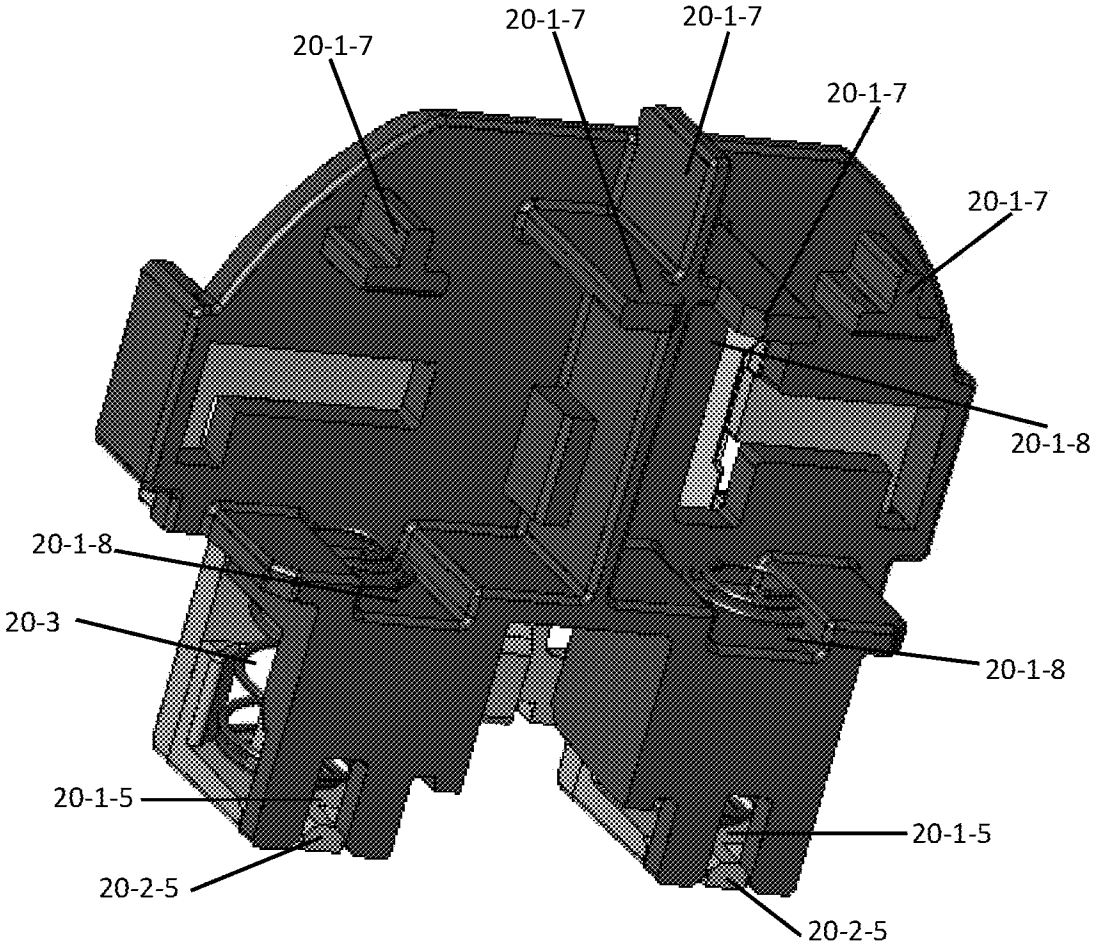
FIG. 17E is a back side perspective view of the shutter assembly of a tamper resistant electrical receptacle according to the embodiment shown in FIG. 3.

Turning to FIGS. 17C-E, front perspective, front right side perspective, and back side perspective views of the shutter assembly 20' of the 20A version of a 250V tamper resistant electrical receptacle 10', respectively, are shown. Among other elements, the shutter assembly 20' and springs 7 are shown assembled together with frame 20-1. These Figures are similar to the embodiment shown in and described with respect to FIGS. 10B-D.

Figure 18:
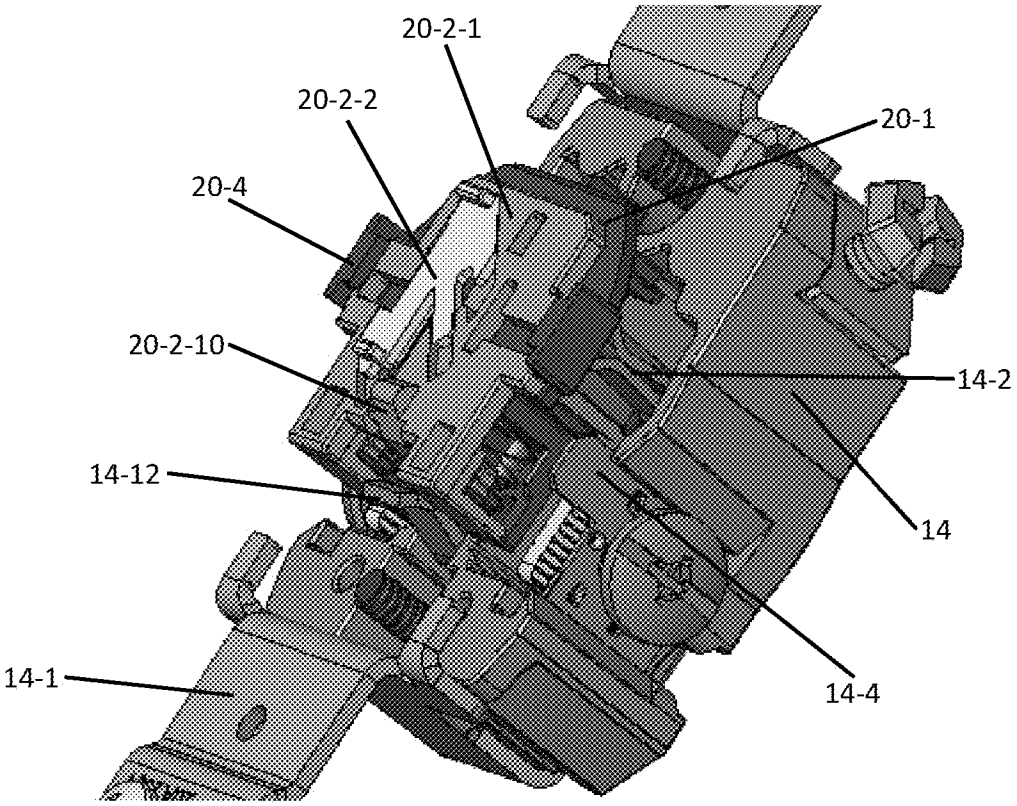
FIG. 18 is a front right side perspective views of a tamper resistant electrical receptacle with certain components removed according to the embodiment shown in FIG. 3.
Figure 19:
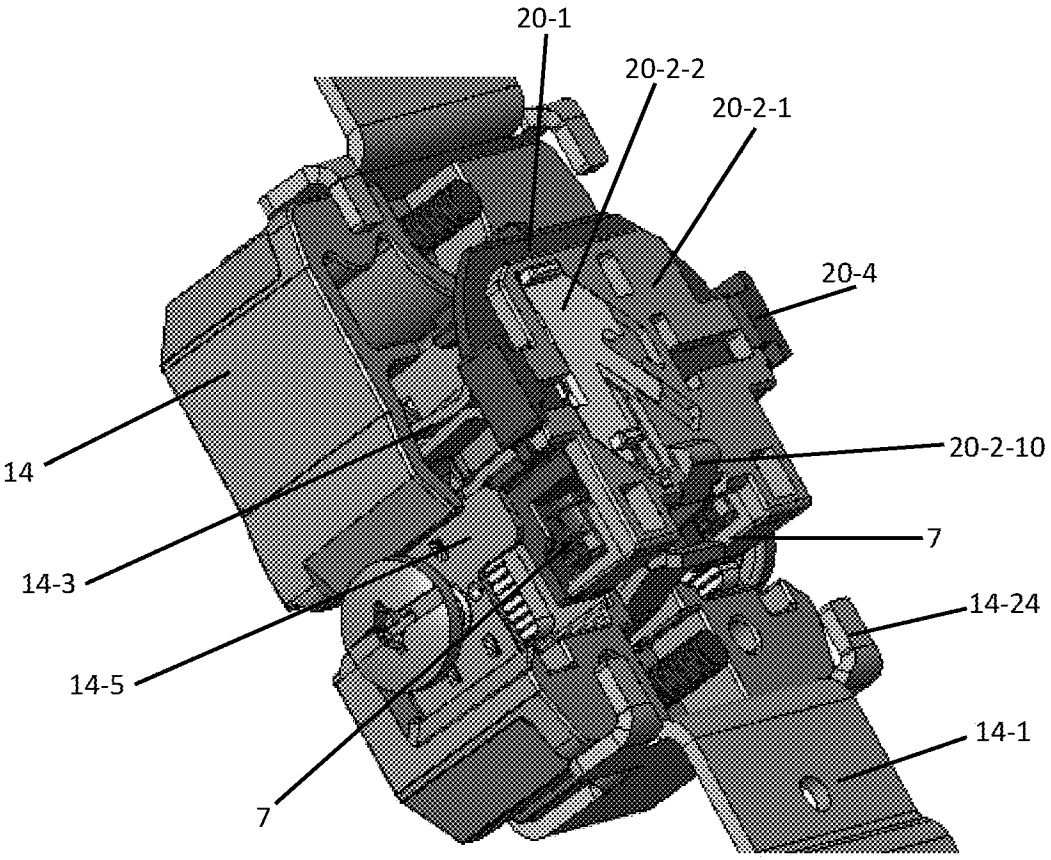
FIG. 19 is a front left side perspective views of a tamper resistant electrical receptacle with certain components removed according to the embodiment shown in FIG. 3.

Turning to FIGS. 18 and 19, front right side and front left side perspective views of the 20A version of a 250V tamper resistant electrical receptacle 10' with the cover 12 removed, respectively, are shown. These Figures are similar to the embodiment shown in and described with respect to FIGS. 9-10A.

Figure 20:
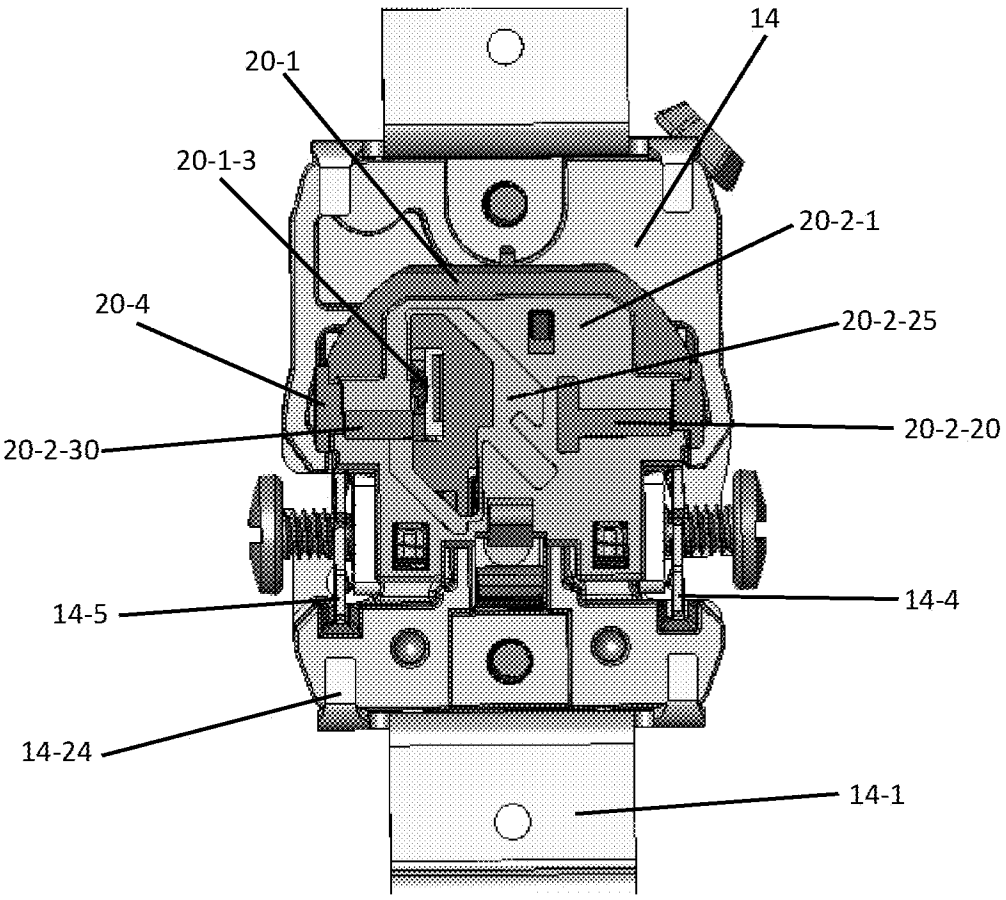
FIG. 20 is a front view of a tamper resistant electrical receptacle with certain components removed according to the embodiment shown in FIG. 3.
Figure 31:
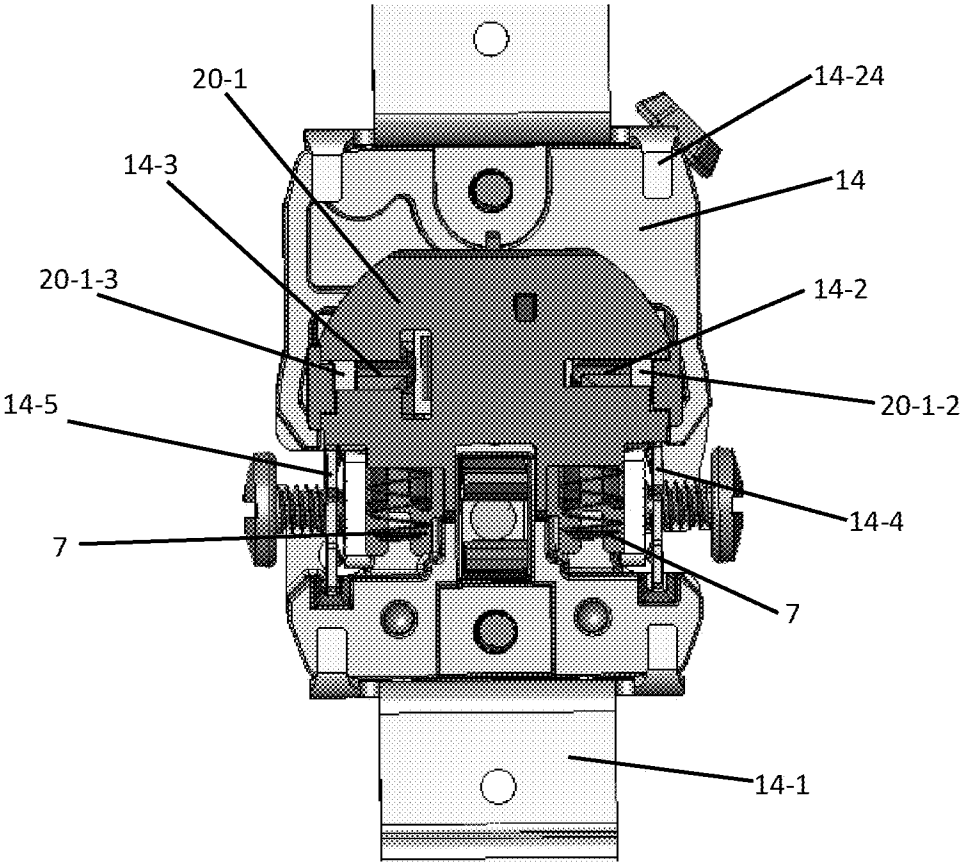

Referring to FIG. 20, a front view of the 20A version of a 250V tamper resistant electrical receptacle 10' is shown with the cover 12 and shutter 20-2-2 removed to show the shutter 20-2-1 and frame 20-1 positioned over and within body 14. This Figure is similar to the embodiment shown in and described with respect to FIG. 16.

Referring to FIG. 21, a front view of the 20A version of a 250V tamper resistant electrical receptacle 10' is shown with the cover 12 and shutter assembly 20' removed to show the frame 20-1 positioned over and within body 14. Openings 20-1-3 and 20-1-2 are shown exposed without the shutter assembly 20' being present, and the hot contacts 14-2 and neutral contacts 14-3 are exposed. This Figure is similar to the embodiment shown in and described with respect to FIG. 11.

Figure 22:
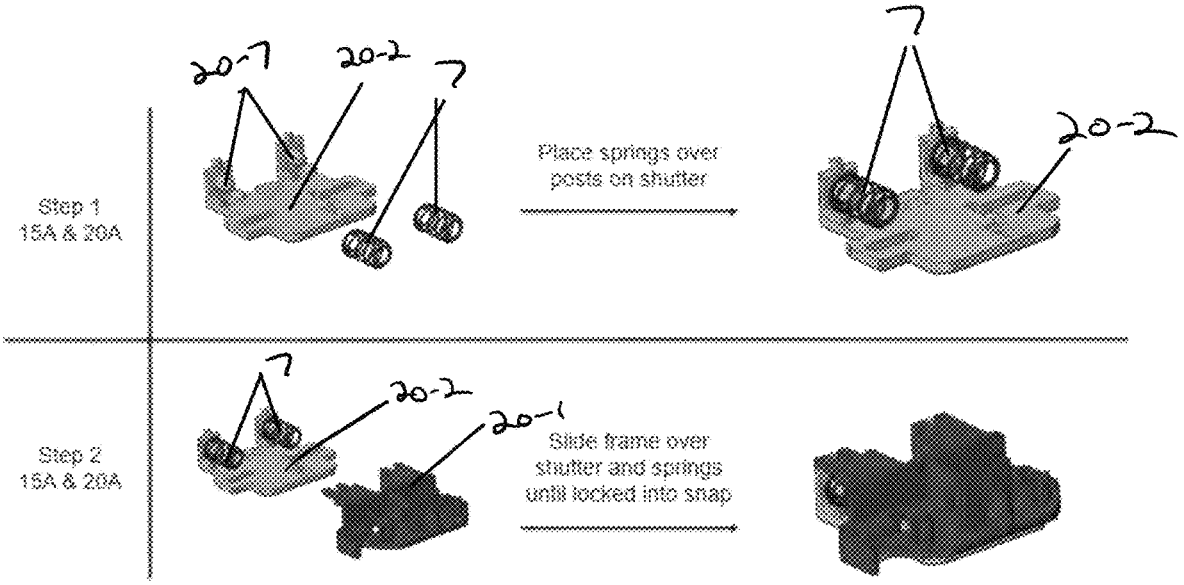
FIG. 22 are front perspective views of part of a process showing the assembly of a shutter assembly according to an embodiment.
Figure 23:
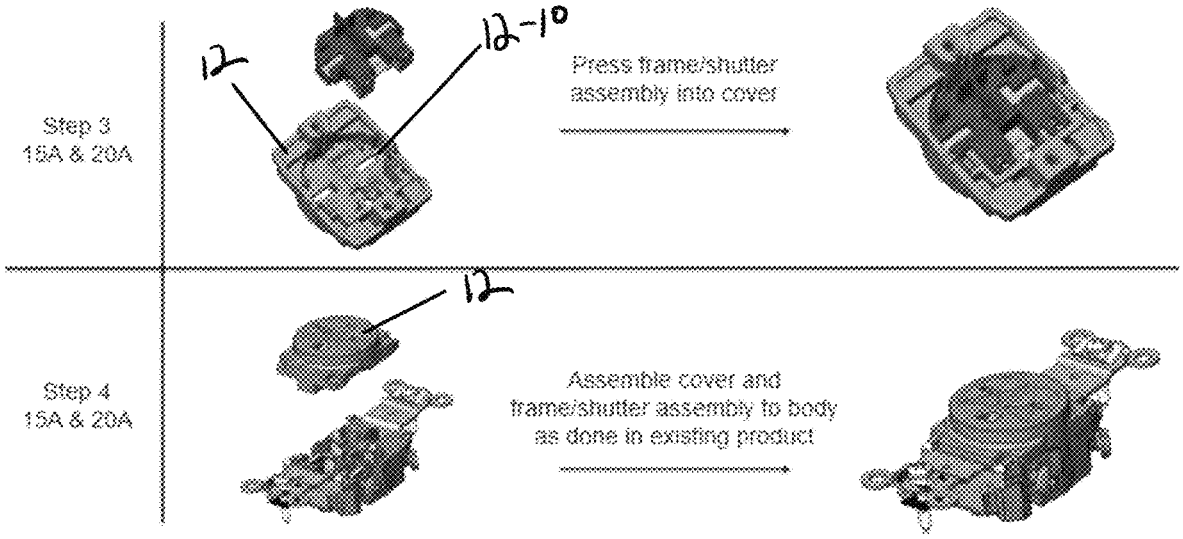
FIG. 23 are front perspective views of part of a process showing the assembly of a shutter assembly and a tamper resistant electrical receptacle according to an embodiment FIG. 24 are front perspective views of part of a process showing the assembly of a shutter assembly according to an embodiment.
Figure 24:
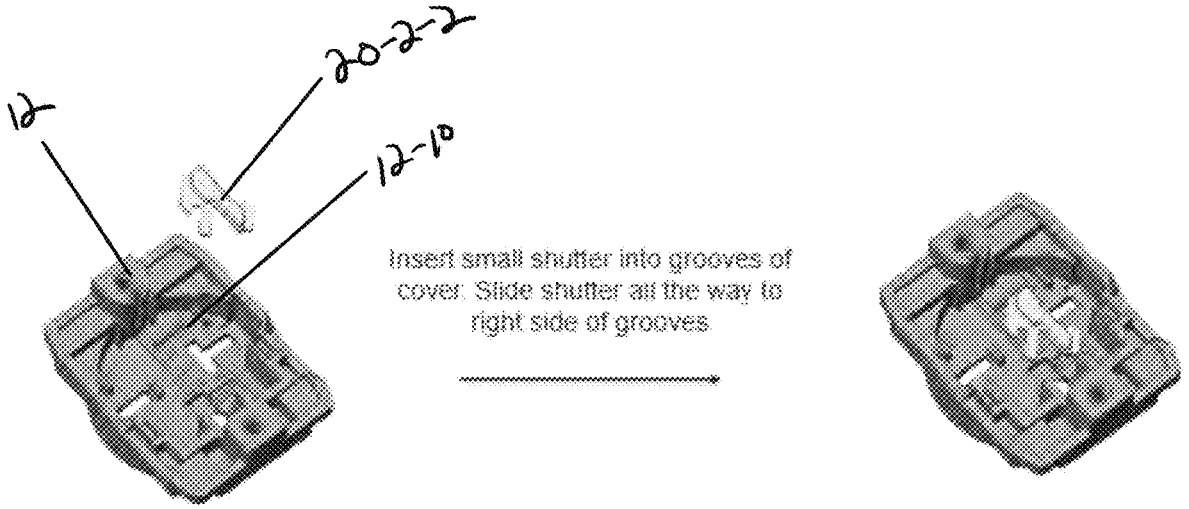

FIGS. 22-24 illustrate a process of assembling the shutter assemblies 20 and 20' with frame 20-1. In brief, step 1 shows the positioning of springs 7 onto pegs 20-7 of shutter 20-2. Step 2 shows the formation of the shutter 20-2 and springs with frame 20-1 combination (a similar process can be performed with shutter 20-2-1, springs 7 and frame 20-1, not shown). Step 3 shows the positioning of the shutter 20-2 and springs with frame 20-1 combination into the interior recess 12-10 of cover 12. When assembling the 20A version, shutter 20-2-2 is preferably positioned within the interior recess 12-10 of cover 12 prior to step 3, as shown in FIG. 24. Step 4 shows the cover 12, shutter assembly 20/20', and frame 20-1 combination attached to and partially within body 14 of the electrical wiring device.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. An electrical wiring device comprising:

a housing including a front cover coupled to at least one body member, the front cover including a plurality of receptacle openings in a major front surface thereof, the plurality of receptacle openings being configured to receive a plurality of plug blades of a corded electrical plug, wherein the plurality of receptacle openings includes at least a ground prong opening and the at least one body member includes at least one set of receptacle contacts including a hot receptacle contact and a neutral receptacle contact; and a shutter assembly positioned within the housing and including a first shutter member coupled to a second shutter member, wherein the first shutter member is configured to move from a first position to a second position when a ground prong is inserted through the ground prong opening.

2. The electrical wiring device of claim 1, wherein the first shutter member is configured to move from the first position to the second position in a first single plane.

3. The electrical wiring device of claim 2, wherein the first shutter member is biased to the first position by at least one biasing member when the ground prong is not inserted through the ground prong opening.

4. The electrical wiring device of claim 3, wherein when the first shutter member is in the first position, the first shutter member is in a blocking position and is configured to block access to the at least one set of receptacle contacts through the plurality of receptacle openings.

5. The electrical wiring device of claim 4, wherein when the first shutter member is in the second position, the first shutter member is in an open position and is configured to allow access to the at least one set of receptacle contacts through the plurality of receptacle openings.

6. The electrical wiring device of claim 1, further comprising a third shutter member configured to move from a third position to a fourth position when a ground prong is inserted through the ground prong opening.

7. The electrical wiring device of claim 6, wherein the third shutter member is configured to move within a recess formed in a front surface of the second shutter member when moving from the third position to the fourth position.

8. The electrical wiring device of claim 7, wherein the movement of the third shutter member from the third position to the fourth position is in a second single plane parallel to the first single plane.

9. The electrical wiring device of claim 8, wherein a directional movement of the third shutter member from the third position to the fourth position is at an angle to a directional movement of the second shutter member.

10. The electrical wiring device of claim 9, wherein the third shutter member is biased to the third position by at least one biasing member when the ground prong is not inserted through the ground prong opening.

11. The electrical wiring device of claim 10, wherein when the third shutter member is in the third position, the third shutter member is in a blocking position and is configured to block access to the at least one set of receptacle contacts through the plurality of receptacle openings.

12. The electrical wiring device of claim 11, wherein when the third shutter member is in the fourth position, the third shutter member is in an open position and is configured to allow access to the at least one set of receptacle contacts through the plurality of receptacle openings.

13. The electrical wiring device of claim 1, wherein the second shutter member comprises a ramp extending from a front surface of the second shutter member toward the front cover, positioned adjacent to the ground prong opening and configured to be contacted by the ground prong.

14. The electrical wiring device of claim 13, wherein the second shutter member includes at least one L-shaped leg.

15. The electrical wiring device of claim 14, wherein the first shutter member comprises at least one L-shaped leg that is opposite and complimentary to the L-shaped leg of the second shutter member forming a first space between the two L-shaped legs.

16. The electrical wiring device of claim 15, wherein at least one spring is positioned within the first space.

17. The electrical wiring device of claim 16, wherein an inner surface of the L-shaped leg of the first shutter member includes a peg extending therefrom on which the at least one spring is positioned.

18. The electrical wiring device of claim 16, wherein the distal end of L-shaped leg of the second shutter member or of the first shutter member comprises a protrusion and the distal end of the other of the second shutter member or of the first shutter member comprises a channel within which the protrusion fits and is configured to move within.

* * * * *